US005743080A

United States Patent [19]

Ginter

[11] Patent Number: 5,743,080

[45] Date of Patent: Apr. 28, 1998

[54] VAPOR-AIR STEAM ENGINE

[75] Inventor: J. Lyell Ginter, Fresno, Calif.

[73] Assignee: Ginter Vast Corporation, Los Angeles, Calif.

[21] Appl. No.: 232,047

[22] PCT Filed: Oct. 27, 1993

[86] PCT No.: PCT/US93/10280

§ 371 Date: Apr. 26, 1994

§ 102(e) Date: Apr. 26, 1994

[87] PCT Pub. No.: WO94/10427

PCT Pub. Date: May 11, 1994

Related U.S. Application Data

[63] Continuation-in-part of Ser. No. 967,288, Oct. 27, 1992, Pat. No. 5,221,041.

[51] Int. Cl.[6] ..... F02C 3/00

[52] U.S. Cl. ..... 60/39.05; 203/11; 203/DIG. 20; 60/39.26; 60/39.55

[58] Field of Search ..... 60/39.03, 39.05, 60/39.26, 39.29, 39.55; 203/10, 11, 12, DIG. 17, DIG. 20

[56] References Cited

U.S. PATENT DOCUMENTS

| | | | |
|---|---|---|---|
| 3,651,641 | 3/1972 | Ginter . | |
| 3,657,879 | 4/1972 | Ewbank et al. . | |
| 3,885,390 | 5/1975 | Evans . | |
| 3,899,886 | 8/1975 | Swick . | |
| 3,902,316 | 9/1975 | Huellmantel . | |
| 3,919,838 | 11/1975 | Armstrong et al. . | |
| 4,041,699 | 8/1977 | Schelp . | |
| 4,213,297 | 7/1980 | Förster . | |
| 4,248,039 | 2/1981 | Cheng . | |
| 4,387,576 | 6/1983 | Bissell . | |
| 4,426,842 | 1/1984 | Collet . | |
| 4,569,195 | 2/1986 | Johnson . | |
| 4,660,376 | 4/1987 | Johnson . | |
| 4,674,275 | 6/1987 | Stroem . | |
| 4,733,527 | 3/1988 | Kidd | 60/39.55 |
| 4,753,068 | 6/1988 | El-Masri . | |
| 4,773,846 | 9/1988 | Munk . | |
| 4,928,478 | 5/1990 | Maslak . | |
| 4,932,206 | 6/1990 | Sawyer et al. . | |
| 5,079,911 | 1/1992 | Kumakura . | |
| 5,117,625 | 6/1992 | McArthur et al. | 60/39.29 |

FOREIGN PATENT DOCUMENTS

| | | |
|---|---|---|
| 0209820 | of 1986 | European Pat. Off. . |
| 2087252 | of 1981 | United Kingdom . |
| 2158158 | of 1985 | United Kingdom . |

*Primary Examiner*—Charles G. Freay
*Attorney, Agent, or Firm*—Michael J. Ram; Marvin H. Kleinberg; Marshall A. Lerner

[57] ABSTRACT

A vapor-air steam engine is described which operates at high pressure and utilizes a working fluid consisting of a mixture of compressed uncombusted air components, fuel combustion products and steam.

In the new cycle described, working fluid is provided at constant pressure and temperatures. Combustion air is supplied adiabatically by one or more stages of compression. Fuel is injected at pressure as needed. At least about 40% to all of compressed air is burned. Inert liquid is injected at high pressure to produce steam and thus provide an inert high specific heat diluent vapor required for internal cooling of an internal combustion turbine or other type system.

The use of extensive liquid injection inhibits the formation of pollutants, increases the efficiency and horsepower of an engine, and reduces specific fuel consumption. The new cycle may also be operated open or closed; in the latter case, the liquid may be recouped via condensation for regenerative reuse.

When salt water is injected into the system potable water is recovered from the steam exiting the power turbine and sterile sea salt is recovered from the combustion chamber.

28 Claims, 8 Drawing Sheets

VAPOR-AIR STEAM ENGINE

This application is a 371 of PCT/US93/10280 filed Oct. 27, 1993 and a continuation-in-part of U.S. Ser. No. 07/967,288 filed Oct. 27, 1992 now U.S. Pat. No. 5,221,041 issued Jun. 22, 1993.

FIELD OF THE INVENTION

The present invention is directed to a vapor-air steam engine which operates at high pressure and utilizes a working fluid consisting of a mixture of compressed air, fuel combustion products and steam. The invention is further directed to processes for producing electrical energy in a fuel burning system at high efficiency and low specific fuel consumption. The invention is still further directed to the production of potable water while generating electrical power without significantly reducing the efficiency or increasing the fuel consumption.

BACKGROUND OF THE INVENTION

Internal combustion engines ("ICEs") are generally classified as either constant volume or constant pressure. Otto cycle engines operate by exploding volatile fuel in a constant volume of compressed air near top dead center while diesel cycle engines burn fuel in a modified cycle, the burning being approximately characterized as constant pressure.

External combustion engines ("ECEs") are exemplified by steam engines and turbines and some forms of gas turbines. It has been known to supply a gas turbine with a fluid heated and compressed from an external fluid supply source and to operate various motor devices from energy stored in this compressed gas.

It is also known to burn fuel in a chamber and exhaust the combustion products into a working cylinder, sometimes with the injection of water or steam in accordance with the rising temperature. These may also be classified as ECEs.

Some other devices have been proposed in which combustion chambers are cooled by addition of water or steam internally rather than employing external cooling. Still another form of apparatus has been proposed for operation on fuel injected into a combustion cylinder as the temperature falls, having means to terminate fuel injection when the pressure reaches a desired value.

Each of these prior engines has encountered difficulties which have prevented their general adoption as a power source for the operation of prime movers. Among these difficulties have been the inability of such an engine to meet sudden demand and/or to maintain a constant working temperature or pressure as may be required for efficient operation of such an engine.

Furthermore, control of such engines has been inefficient, and the ability of the gas generator to maintain itself in standby condition has been wholly inadequate. In all practically applied engine configurations the requirement for cooling the confining walls of the work cylinders has resulted in loss of efficiency and a number of other disadvantages previously inherent in ICEs.

The present invention overcomes the limitations of the prior art described above. First, the requirement of air or liquid external cooling is eliminated by injecting water into the combustion process to control the temperature of the resulting working fluid. When water is injected and converted into steam in this way, it becomes a portion of the working fluid itself, thus increasing the volume of working fluid without mechanical compression. The working fluid is increased when excess combustion gas temperature is transformed into steam pressure.

In the present invention, independent control of the combustion flame temperature and fuel to air ratio is used in order to accommodate the requirements of a working engine. Control of the flame temperature also prevents the formation of $NO_x$, and the disassociation of $CO_2$ as described below.

The present invention also utilizes high pressure ratios as a way of increasing efficiency and horsepower while simultaneously lowering specific fuel consumption ("sfc"). When water is injected and converted into steam in the combustion chamber of the present invention, it acquires the pressure of the combustion chamber. It should be noted that this pressure of the combustion chamber is acquired by the steam irrespective of the pressure ratio of the engine. Thus, a higher pressure ratio can be obtained in the engine without expending additional work for performing compression for new steam or water injection. Because of massive water injection used in the present invention, there is no need to compress dilution air typically used in prior art systems for cooling. The elimination of this requirement results in an enormous energy savings to the system.

Because the pressure ratio is increased in a device using water injection as taught in the present invention, several advantages are apparent. To begin with, no additional work is required to compress water or steam further after they have been initially compressed; in other words, after compressing steam to 2 atmospheres, no additional work is required to compress it further to a higher pressure. This is unlike air, for example, for which additional work must be expended to raise it to higher pressures and thus acquire additional working fluid mass. Furthermore, when water is injected and converted to steam in the present invention, it acquires the pressure of the combustion chamber without additional work. This steam also has constant entropy and enthalpy.

In the present invention excess waste heat from combustion is converted to steam pressure and as an additional mass for the working fluid without mechanical compression. In contrast, in a typical Brayton Cycle Turbine, 66%–75% of the mechanically compressed air is used for air dilution with the products of combustion in order to reduce the temperature of the working fluid to Turbine Inlet Temperature ("TIT") requirements.

Since the steam doubles or more the combustion generated working fluid and produces 15% or more of the net horsepower, the water can be seen to serve as a fuel in this new thermodynamic system because it supplies pressure, power and efficiency to the present system.

The cycle of the present invention may be open or closed with respect to either or both air and water. Desalination or water purification could be a byproduct of electric power generation from a stationary installation or water borne ships, where the cycle is open as to air but closed as to the desalinated water recovery. Marine power plants or irrigation water clean up systems are also viable environments.

The present cycle can also be employed in the closed cycle phase in mobile environments, e.g. autos, trucks, buses, commuter aircraft, general aviation and the like.

SUMMARY OF THE INVENTION

One of the objectives of this invention is to provide a new, thermodynamic power cycle which may be open or closed, and that compresses air and stoichiometrically combusts fuel and air so as to provide efficient clean pollution controlled power.

It is also an object of this invention to completely control the temperature of combustion within an engine through the employment of the latent heat of vaporization of water without the necessity to mechanically compress dilution air.

A further object of this invention is to reduce the air compressor load in relation to a power turbine used in the engine so that slow idling and faster acceleration can be achieved.

A further object of this invention is to separately control the TIT on demand.

Another object of this invention is to vary the composition of working fluid on demand.

It is also an object of this invention to provide sufficient dwell time in milliseconds to permit stoichiometric combustion, bonding, and time for complete quenching and equilibrium balance.

It is also an object of this invention to so combust and to so cool the products of combustion as to prevent the formation of smog causing components such as $NO_x$, HC—, CO—, particulates, $CO_2$ dissociation products, etc.

It is also an object of this invention to provide a combustion system which provides 100% conversion of one pound of chemical energy to one pound of thermal energy.

It is also an object of this invention to operate the entire power system as cool as possible and still operate with good thermal efficiency.

It is also an object of this invention to provide a condensing process to some value of vacuum in order to cool, condense, separate, and reclaim the steam as condensed water.

It is also an object of this invention to provide an electric power generating system which uses sea water as its coolant and produces potable water desalinated as a product of the electric power generation.

It is also an object of this invention to provide a new cycle which incorporates a modified Brayton cycle during the top half of engine operation, and a vapor air steam cycle during the lower half of engine operation.

It is also an object of this invention to provide a turbine power generating system which produces electrical energy at a greater efficiency and reduced specific fuel consumption when compared with currently available system.

It is also an object of this invention to provide a power generating system which produces electrical energy at an overall efficiency significantly greater than 40%.

In accordance with one exemplary embodiment of the present invention, an internal combustion engine is described. This engine includes a compressor configured for compressing ambient air into compressed air having a pressure greater than or equal to six atmospheres, and having an elevated temperature. A combustion chamber connected to the compressor is configured to duct a progressive flow of compressed air from the compressor. Separate fuel and fluid injection controls are used for injecting fuel and water respectively into the combustion chamber as needed. The amount of compressed air, fuel and fluid injected and the temperature of the injected water are each independently controlled. Thus, the average combustion temperature and the fuel to air ratio can also be independently controlled. The injected fuel and a controlled portion of the compressed air is combusted, and the heat generated transforms the injected fluid into a vapor. The transformation of the injected fluid into a vapor reduces the outlet temperature of the gases exiting the combustion temperature by way of the latent heat of vaporization. An amount of fluid significantly greater than the weight of the fuel of combustion is used. Therefore, the mass flow of combustion generated working fluid may be doubled or greater under most operating conditions.

A working fluid consisting of a mixture of compressed air, fuel combustion products and vapor is thus generated in the combustion chamber during combustion at a predetermined combustion temperature. This working fluid can then be supplied to one or more work engines for performing useful work.

In more specific embodiments of the present invention, an ignition sparker is used to start the engine. The engine may also be operated either open or closed; in the latter case, a portion of the working fluid exhaust may be recuperated. The combustion chamber temperature is determined based on information from temperature detectors and thermostats located therein.

When the present invention is used, the combustion temperature is reduced by the combustion control means so that stoichiometric bonding and equilibrium is achieved in the working fluid. All chemical energy in the injected fuel is converted during combustion into thermal energy and the vaporization of water into steam creates cyclonic turbulence that assists molecular mixing of the fuel and air such that greater stoichiometric combustion is effectuated. The injected water absorbs all the excess heat energy so as to reduce the temperature of the working fluid below that of a maximum operating temperature of the work engine. When the injected water is transformed into steam, it assumes the pressure of the combustion chamber, without additional work for compression and without additional entropy or enthalpy. The careful control of combustion temperature prevents the formations of gases and compounds that cause or contribute to the formation of atmospheric smog.

In another embodiment of the present invention, electric power is generated which uses sea water as its coolant, and which produces potable water desalinated as a product of the electric power generation.

In a third embodiment of the present invention, a new cycle is described for an engine, so that when the engine is operated in excess of a first predetermined rpm, water injection and the portion of compressed air combusted is constant as engine rpm increases. In between the first and second predetermined rpm, water/fuel is increased, the percentage of air combusted is increased, and combusted air is varied. When the engine is operated below the second predetermined rpm, water injection is proportional to fuel and constant while the percent of compressed air combusted is held constant.

The use of such a cycle results in increased horsepower, low rpm, slow idle, fast acceleration and combustion of up to 95% of the compressed air at low rpm.

A more complete understanding of the invention and further objects and advantages thereof will become apparent from a consideration of the accompanying drawings and the following detailed description. The scope of the present invention is set forth with particularity in the appended claims.

DETAILED DESCRIPTION OF THE INVENTION

A. Basic Configuration Of The Present System

Figure 1:
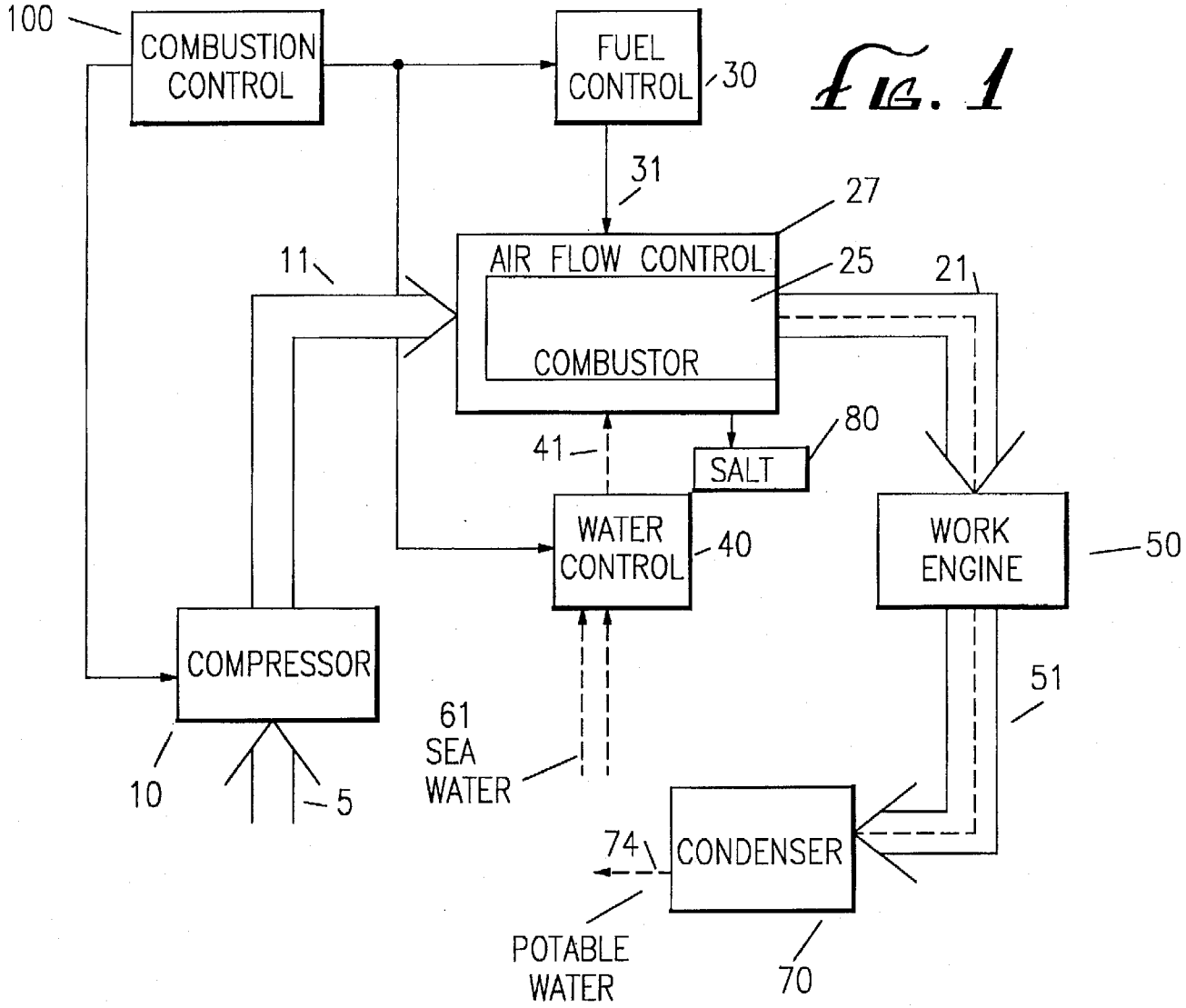
FIG. 1 is a block diagram of a vapor-air steam turbine engine in accordance with a present invention.

Referring now to FIG. 1, there is shown schematically a gas turbine engine embodying the teachings of the present invention. Ambient air 6 is compressed by compressor 10 to a desired pressure ratio resulting in compressed air 11. In a preferred embodiment, compressor 10 is a typical well-known three stage compressor, and the ambient air is compressed to a pressure greater than four atmospheres, and preferably 22 atmospheres, at a temperature of approximately 1400° R.

Figure 11:
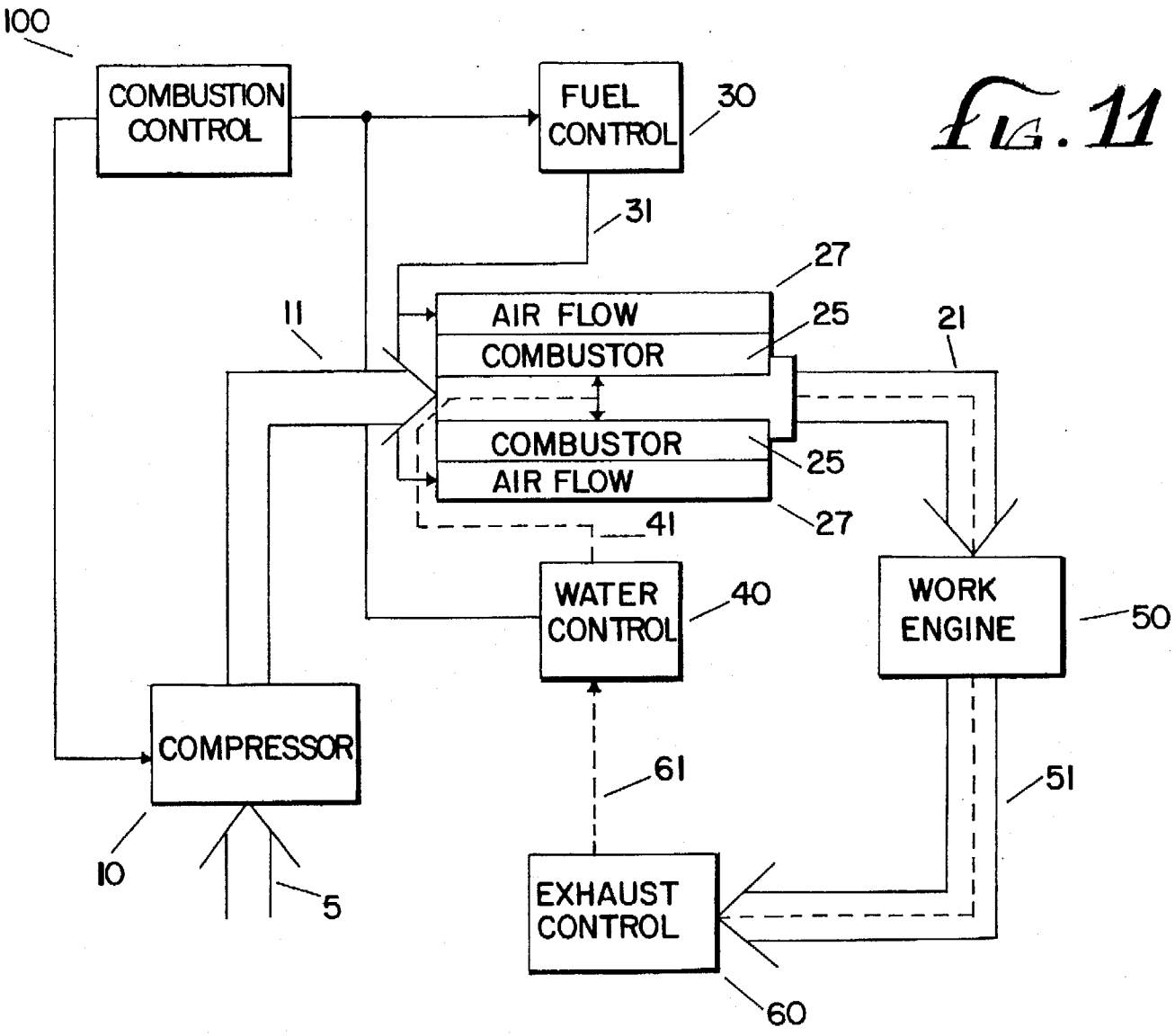
FIG. 11 is a schematic diagram of a further embodiment of a vapor-air stream turbine engine with two parallel combustors.

The compressed air 11 is supplied by an air flow controller 27 to a combustor 25 or two combustors 25 as shown in FIG. 11. Combustors are well-known in the art, and, in the present invention, the compressed air 11 may be supplied in a staged, circumferential manner by air flow control 27 similar to that shown in U.S. Pat. No. 3,651,641 (Ginter) which is hereby incorporated by reference. The compressed air 11 is fed in stages by air flow controller 27 in order to keep combustion (flame temperatures) low in combustion chamber 25.

Fuel 31 is injected under pressure by fuel injection control 30. Fuel injection control is also well-known to skilled artisans, and fuel injection control 30 used in the present invention can consist of a series of conventional single or multiple fuel feed nozzles. A pressurized fuel supply (not shown) is used to supply fuel, which can be any conventional hydrocarbon fuel, such as diesel fuel #2 heating oil, preferably sulfur free and alcohols such as ethanol. Ethanol may be preferable in some applications because it includes or can be mixed with at least some water which may be used for cooling combustion products, thus reducing the requirement for injected water. Also ethanol water mixtures have a much lower freezing point thus increasing the ability to use the engine in climates which have temperatures below 32° F.

Water 41 is injected at pressure by water injection control 40 and may be atomized through one or more nozzles 206 into, during and downstream of combustion in combustion chamber 25 as explained further below.

Temperature within combustor 25 is controlled by combustion controller 100 operating in conjunction with other elements of the present invention detailed above. Combustion controller 100 may be a conventionally programmed microprocessor with supporting digital logic, a microcomputer or any other well-known device for monitoring and effectuating control in response to feedback signals from monitors located in the combustion chamber 25 or associated with the other components of the present system.

For example, pressure within combustor 25 can be maintained by air compressor 10 in response to variations in engine rpm. Temperature detectors and thermostats 204 within combustor 25 provide temperature information to combustion control 100 which then directs water injection control 40 to inject more or less water as needed. Similarly, working fluid mass is controlled by combustion control 100 by varying the mixture of fuel, water and air combusted in combustor 25.

There are certain well-known practical limitations which regulate the acceptable high end of combustion temperature. Foremost among these considerations is the maximum TIT which can be accommodated by any system. To effectuate the desired maximum TIT, water injection control 40 injects water as needed to the working fluid to keep the combustion temperature within acceptable limits. The injected water absorbs a substantial amount of the combustion flame heat through the latent heat of evaporation of such water as it is converted to steam at the pressure of combustor 25.

For ignition of the fuel injected into combustor 25, a pressure ratio of greater than 12:1 is needed to effectuate self-compression ignition. A standard ignition sparker 205 can be used with lower pressure ratios, however.

As mentioned above, combustion controller 100 independently controls the amount of combusted compressed air from air flow control 27, fuel injection control 30, and water injection control 40 so as to combust the injected fuel and a portion of the compressed air. At least 95% of the compressed air is combusted. If less than 100% of the $O_2$ is combusted then this leaves sufficient $O_2$ to complete stoichiometric bonding and for acceleration. When 100% of the air is consumed in the combustion process, forming $CO_2$, no oxygen is available to form $NO_x$. The heat of combustion also transforms the injected water into steam, thus resulting in a working fluid 21 consisting of a mixture of compressed, non-combustible components of air, fuel combustion products and steam being generated in the combustion chamber. Pressure ratios from 4:1 to 100:1 may be supplied by compressor 10. TIT temperatures may vary from 750° F. to 2300° F. with the higher limit being dictated by material considerations.

A work engine 50, typically a turbine, is coupled to and receives the working fluid 51 from combustion chamber 25 for performing useful work (such as by rotating a shaft 54 at 202 which, in turn drives load such as a generator 56 which produces electric energy 58. While the present invention discusses the use of a turbine as a work engine, skilled artisans will appreciate that reciprocating, Wankel, cam or other type of work engines may be driven by the working fluid created by the present invention.

The working fluid expands as it passes by work engine 50. After expansion the working fluid 51 is exhausted by exhaust control 60 at varying pressure (anywhere from 0.1 atmospheres on up) depending on whether a closed cycle with vacuum pump or open cycle is used. Exhaust control 60 may also include a heat exchanger 63 and/or condenser 62 for condensing the steam 61 from the working fluid 51 as well as a recompressor 64 for exhausting the working fluid 51. The steam condensed in condenser 62 exits as potable water 65.

B. Thermodynamic Processes Employed In Present Cycle

1. General Explanation

When a combustor as described is employed in a practical engine, a number of thermodynamic advantages are obtained. These will best be understood by reference to the thermodynamic processes of the cycle used in the present invention as shown schematically in P-V and T-S diagrams in FIGS. 2 and 3. The present invention, which utilizes vapor, air and steam in conjunction with a work turbine, is referred to as the VAST™ cycle; VAST being a trademark owned by applicant.

Figure 2:
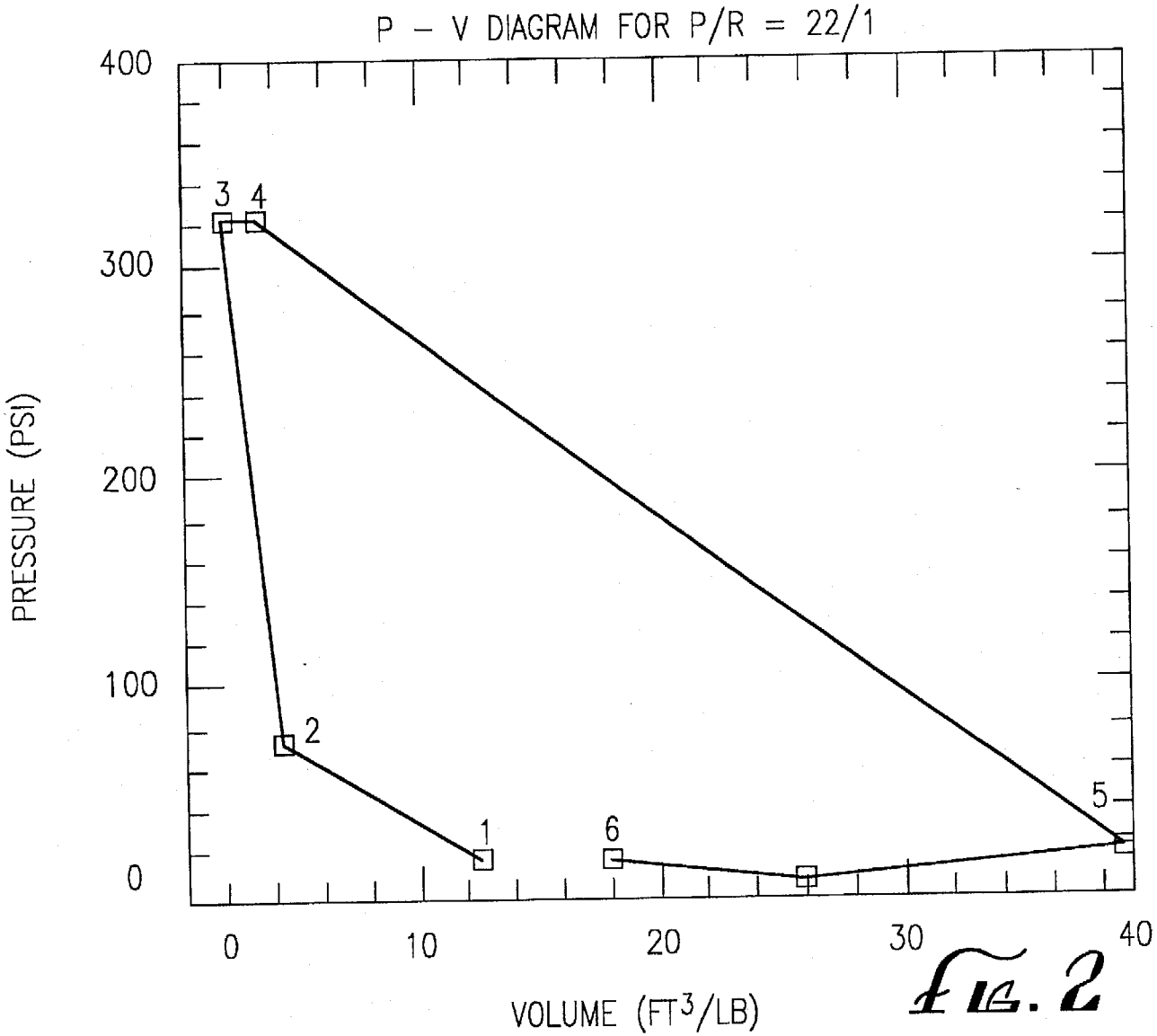
FIG. 2 is a diagram describing the pressure and volume relationship of the thermodynamic process used in the present invention.
Figure 3:
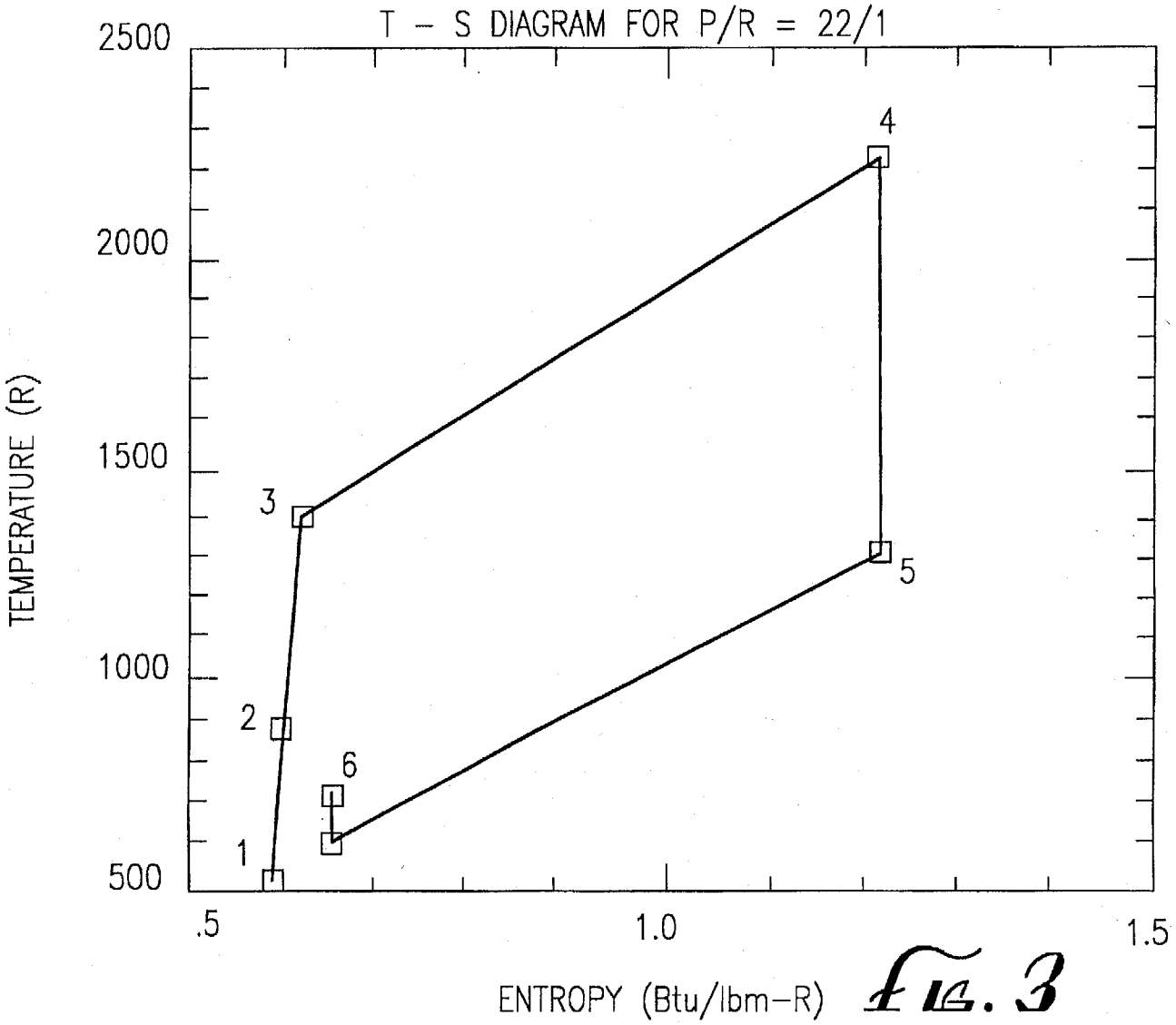
FIG. 3 is a diagram describing the temperature and entropy relationship of the thermodynamic process used in the present invention.

The following parameters were used in plotting the diagrams shown in FIGS. 2 and 3:

Pressure Ratio=22/1

3-Stage Compressor 10

Turbine inlet temperature—1800° F.

Fuel - air ratio=0.066

1 lb. air per second

Water inlet temperature—212° F.

Efficiency of compressors used in Compressor 10=85%

Efficiency of Work Engine (Turbine) 50=85%

However, as discussed below, these operating parameters are merely representative of an embodiment incorporating features of the invention. The pressure ratio, turbine inlet temperature, and water inlet temperature can be varied as required by the application in which the VAST cycle is used. Additionally, the fuel/air ratio changes depending on the type of fuel used to assure stoichiometric quantities and the compressor and turbine efficiency can be increased by use of more efficient designs. Further, FIGS. 2 and 3 were calculated using one pound of air per second. Increasing the air feed while maintaining fuel/air constant results in a proportional increase in the power output.

The VAST cycle is a combination of a compressed air work cycle and a steam cycle since both air and steam are present as a working fluid wherein each makes up a portion of the total pressure developed in the combustor. In the present discussion, it will be understood that the term "air" is intended to include fuel as combusted by the inlet compressed air together with any excess of compressed air which may be present, and thus includes all of the products of combustion, while the term "steam" refers to water which is injected in the liquid state to become superheated steam, but which also is used in a work cycle with a change of state in which a part of the steam becomes liquid water. The new cycle or process of burning fuel makes use of the combined steam and air as a working fluid, with the exception of the compression process in which air only is involved.

A discussion of the thermodynamic processes in the VAST cycle now follows. As shown in FIGS. 2 and 3, processes 1-2 and 2-3 show the compression in the compressors of three stage compressor 10. The exit conditions at the outlet of compressor 10 are calculated using isentropic relations for compression and the real conditions are calculated using a compressor efficiency of 85%.

As explained above, compressed air enters combustion chamber 25 through air flow control 27. The combustion chamber process is shown in FIGS. 2 and 3 as processes 3-4.

The combustion chamber 25 burns fuel at constant pressure under conditions also approximating constant temperature burning. The temperature is completely controllable since there are independent fuel, air and water controls. Compressed air input to the combustor, after start-up, is at constant pressure. Thus, the combination of the air feed at a constant pressure and a fixed fuel/air ratio in combination with control of the TIT by water injection results in a constant pressure in the combustion chamber. Burning occurs in the combustor immediately following injection of fuel under high pressure and provides idealized burning conditions for efficiency and avoidance of air contaminants in which the fuel mixture may at first be richer than the mixture for complete combustion, additional air being added as burning continues, this air being added circumferentially around the burning fuel and in an amount which, as a minimum equals the amounts necessary for complete combustion, a stoichiometric amount, but can ultimately exceed that necessary for complete combustion of the fuel components. A minimum of about 95% of the compressed air is combusted in order to leave sufficient $O_2$ to complete stoichiometric bonding and for acceleration.

Water at high pressure, which may be as high as 4000 psi or greater, is injected by water injection control 40. Due to the high temperatures in the combustion chamber 25, the injected water is instantaneously flashed into steam and mixes with the combustion gases. Again, the amount of water that is added into the combustion chamber 25 depends on the prescribed turbine inlet temperature (TIT) and the temperature of the water just prior to injection. Part of the heat released during the combustion of fuel is used to raise the temperature of the compressed air from the three stage compressor 10 to the TIT. The remaining heat of combustion is used to convert the injected water into steam. This process is represented in FIGS. 2 and 3 by the portions on these diagrams designated 3-4.

The general explanation which follows sets forth a single set of operating conditions for system using #2 diesel fuel. In particular, a pressure ratio of 22/1, a turbine inlet temperature of 1800° F., a turbine outlet pressure of 1 atmosphere and a water inlet temperature of 212° F. are indicated. Additionally, the efficiency of the compressor and the work engine have been conservatively set at 85%. This resulted in a net horsepower of 455.11, an SFC of 0.522 and an efficiency of 0.251 (data table). The examples calculated in the attached computer printout of a simulated process and listed in the data tables show the result of varying the pressure ratio from 10 to 50 with the f/a, water temperature and turbine inlet temperature held constant.

In a like manner, other operating conditions can be varied. For example the water temperature can be increased, the maximum temperature being not greater than the desired TIT. Preferentially, the water temperature is not increased to a temperature greater than about 50° F. below the desired TIT. However, for practical reasons, since the working fluid exiting the turbine is used to heat the feed water, the inlet water is usually held to no more than about 50° F. below the turbine exit temperature. The higher the water temperature the greater the volume of water necessary to reduce the combustion temperature to the TIT, thus resulting in a greater volume of gases flowing to the turbine and a greater power output. Likewise the TIT can be raised or lowered. Examples 1–10 in the data table were calculated at a TIT equal to 1800° F. This is the generally accepted maximum for turbines which do not utilize high temperature alloys or hollow blade cooling with either air or steam. However, utilization of high temperature and/or corrosion resistant alloys, high temperature composites, ceramics and other materials designed for high temperature operation, such as used in turbine jet engines will allow operation as high as 2300° F. Examples 11–16 illustrate operation at more elevated temperatures.

Examples 1–5 of Table 1 show the effect on horsepower, efficiency and SFC by increasing the air compression ratio. The effect of raising inlet water temperature and reducing the exit pressure (calculated at a turbine efficiency and compressor efficiency of 85%) is shown in Examples 6–10. Examples 11–16 show the effect of air compression ratio on a system with a TIT of 2000° F., a turbine exit pressure of 0.5 atmosphere and a $H_2O$ inlet pressure of about 625° to about 700° F. when calculated at an assumed turbine efficiency of 90%. It should be noted that a turbine efficiency of 93% is claimed by currently available air compression axial turbines and the power turbine expander train.

In examples 1 through 16, the fuel is diesel #2 and the fuel to air ratio is 0.066, which is the stoichiometric ratio for #2 diesel fuel. With other fuels a different f/a ratio is required to maintain stoichiometric conditions. Example 17 uses methane and a f/a=0.058. Because methane burns more efficiently than diesel fuel, less fuel per pound of air is used and, as a result, less water is added.

TABLE 1

| Ex. | Air Comp. Ratio | Turbine Efficiency, % | $H_2O$ Inlet Temp, °F. | TIT °F. | Turbine Exit Press atmospheres | Closed Cycle HP | EFF | SFC |
|---|---|---|---|---|---|---|---|---|
| 1 | 10:1 | 85 | 212 | 1800 | 1 | 354.14 | 0.200 | 0.671 |
| 2 | 22:1 | 85 | 212 | 1800 | 1 | 427.48 | 0.241 | 0.556 |
| 3 | 30:1 | 85 | 212 | 1800 | 1 | 444 | 0.25 | 0.535 |
| 4 | 40:1 | 85 | 212 | 1800 | 1 | 454.64 | 0.256 | 0.523 |
| 5 | 50:1 | 85 | 212 | 1800 | 1 | 460 | 0.259 | 0.517 |
| 6 | 22:1 | 85 | 410 | 1800 | 1 | 466 | 0.263 | 0.51 |
| 7 | 22:1 | 85 | 410 | 1800 | .5 | 518.17 | 0.292 | 0.459 |
| 8 | 22:1 | 85 | 410 | 1800 | .25 | 522 | 0.294 | 0.455 |
| 9 | 22:1 | 85 | 600 | 1800 | .5 | 579.26 | 0.326 | 0.410 |
| 10 | 22:1 | 85 | 665 | 1800 | .5 | 615.85 | 0.347 | 0.386 |
| 11 | 5:1 | 90 | 700 | 2000 | .5 | 547.56 | 0.309 | 0.434 |
| 12 | 10:1 | 90 | 704 | 2000 | .5 | 709 | 0.400 | 0.335 |
| 13 | 15:1 | 90 | 697 | 2000 | .5 | 745.31 | 0.42 | 0.319 |
| 14 | 20:1 | 90 | 677 | 2000 | .5 | 759.77 | 0.428 | 0.313 |
| 15 | 25:1 | 90 | 653 | 2000 | .5 | 752.93 | 0.424 | 0.316 |
| 16 | 30:1 | 90 | 629 | 2000 | .5 | 769.04 | 0.433 | 0.309 |
| 17 | 29:1 | 93 | 664 | 2175 | .5 | 840.31 | 0.475 | 0.250 |

Example 17 is also calculated at a turbine efficiency of 93%, and a turbine inlet temperature of 2175° F. which are both claimed as operating parameters of commercially available turbines (which do not use the claimed invention.)

The effect of changing air compression ratio on the performance of the systems listed in examples 11–16 are plotted on FIGS. 7–10.

The combustor of the invention differs from prior devices in a fundamental aspect since the working fluid may be increased either at constant pressure, constant temperature or both. Constant temperature is maintained by combustion controller 100 through controlled water injection by water injection control 40 in response to temperature monitors (thermostats) in combustor 25. Within combustor 25, typical combustion temperatures for liquid hydrocarbon fuels reach about 3,000° to 3,800° F. when a stoichiometric amount or a small excess of compressed air is supplied by compressor 10. Larger quantities of excess air would of course reduce the resulting combustion temperature but would not greatly affect the actual temperature of burning or the ignition temperature.

The practical limit of the discharge temperature from the combustor 25 is in turn governed by the material strength of the containing walls at the discharge temperature, the high temperature tolerance of the combustor walls, the materials of construction of the power turbine, and whether the turbine blades are separately cooled, either externally or internally. This discharge temperature is controlled between suitable limits by variation in the injection of high pressure water which then flashes to steam the heat of the vaporization and superheat being equated to the heat of combustion of the fuel being burned. (The temperature of the burning fuel is reduced to the desired TIT by the heat of vaporization and superheat as the water vaporizes and then heats up to the TIT). The quantity of injected water is thus determined by the desired operating temperature, being less for high superheats, but actually maintaining a fixed operating temperature.

The working pressure is kept constant by compressor 10 as required by any give engine rpm.

The resulting working fluid mixture of combustion gases and steam is then passed into a working engine 50 (typically a turbine as explained above) where expansion of steam - gas mixture takes place. The exit conditions at the outlet of working engine 50 are calculated using isentropic relations and turbine efficiency. This process is shown in FIGS. 1 and 2 by 4–5.

The exhaust gases and steam from work engine 50 are then passed through an exhaust control 60. Exhaust control 60 includes a condenser where the temperature is reduced to the saturation temperature corresponding to the partial pressure of steam in the exhaust. The steam in the turbine exhaust is thus condensed and pumped back into the combustion chamber 25 by water injection control 40. The remaining combustion gases are then passed through a secondary compressor where the pressure is raised back to the atmospheric pressure so that it can be exhausted into the atmosphere.

It can be seen that the present invention makes substantial advantage of the latent heat of vaporization of water. When water is injected into a combustion chamber, and steam is created, several useful results occur: (1) the steam assumes its own partial pressure; (2) the total pressure in the combustor will be the pressure of the combustion chamber as maintained by the air compressor; (3) the steam pressure is without mechanical cost, except a small amount to pump in the water at pressure; (4) the steam pressure at high levels is obtained without mechanical compression, except the water, with steam at constant entropy and enthalpy. The water conversion to steam also cools the combustion gases, resulting in the pollution control described below.

2. Pollution Control

Any type of combustion tends to produce products which react in air to form smog, whether in engines or industrial furnaces, although of different kinds. The present invention reduces the formation of pollution products in several ways discussed below.

First, internal combustion engines operated with cooled cylinder walls and heads have boundary layer cooling of fuel-air mixtures sufficient to result in small percentages of unburned hydrocarbons emitted during the exhaust stroke. The present invention avoids combustion chamber wall cooling in two distinct ways to keep the burning temperature for the fuel high, both of which are shown in more detail in U.S. Pat. No. 3,651,641 mentioned previously. First, hot compressed air is made to flow by air flow control 27 around an exterior wall of combustor 25 such that combustion occurs only within a small space heated above ignition temperatures. Second, the combustion flame is shielded with air unmixed with fuel. Thus, a hot wall combustion, preferably above 2000° F., is utilized in an engine operating on the present cycle.

Next, smog products are also inhibited by operating the combustor 25 within a defined temperature range. For example, CO and other products of partial combustion are inhibited by high temperature burning, preferably well above 2000° F., and by retaining such products for a considerable dwell time after start of burning. At too high a temperature, however, more nitrous and nitric oxides are formed. Accordingly, neither extremely high nor extremely low temperatures are acceptable for reducing smog products. The combustion controller 100 in the present invention commences burning of the fuel and air at high temperature, then reduces that temperature for a considerable dwell time and then cools (after completion of the burning) to a predefined, smog-inhibiting temperature by the use of water injection. Thus, combustion is first performed in a rich mixture; then sufficient compressed air is added to allow complete combustion of the fuel with a minimum of excess oxygen and to cool the gases below about 3000° F. for about half of the dwell time in the combustion chamber 25; and then water injection is directly added to combustion or upstream by water injection control 40 to maintain an acceptable temperature that assures complete burning of all the hydrocarbons.

In typical engines, hydrocarbon fuels are often burned in a mixture with air a little richer in fuel, i.e., at less than stoichiometric proportions in order to increase efficiency. This, however, results in excess CO and more complex products of incomplete combustion. The present invention, however, because it provides a progressive supply of air through air flow control 27, dilutes the combustion and further reduces such smog products.

Oxides of nitrogen also form more rapidly at higher temperatures as explained above, but can also be reduced by the controlled dilution of the combustion products with additional compressed air.

The present combustion cycle is compatible with complete and efficient fuel burning and eliminates incomplete combustion products and reduces other products such as nitrogen oxides. Combustion controller 100 burns the combustion products at a considerable initial dwell time, after which the products of combustion and excess air are then cooled to an acceptable engine working temperature, which may be in the range of 1000° F. to 1800° F., or even as high as 2300° F. if proper materials of construction are used in the turbine, or may be as low as 700° F. to 800° F.

An equilibrium condition can be created by making combustion chamber 25 anywhere from two to four times the length of the burning zone within combustion chamber 25; however, any properly designed combustion chamber may be used.

A burning as described provides a method of reducing smog-forming elements while at the same time, providing a complete conversion of fuel energy to fluid energy.

The VAST cycle is a low pollution combustion system because the fuel-air ratio and flame temperature are controlled independently. The control of fuel-air ratio, particularly the opportunity to burn all of the compressed air (or to dilute with large amounts of compressed air, if desired) inhibits the occurrence of unburned hydrocarbon and carbon monoxide resulting from incomplete combustion. The use of an inert diluent rather than air permits control of the formation of oxides of nitrogen and represses the formation of carbon monoxide formed by the dissociation of carbon dioxide at high temperature. The use of diluents of high specific heat, such as water or steam, as explained above, reduces the quantity of diluent required for temperature control. In the case of oxides of nitrogen, it should be noted that the VAST cycle inhibits their formation rather than, as is true in some systems, allowing them to form and then attempting the difficult task of removing them. The net result of all of these factors is that VAST operates under a wide range of conditions with negligible pollution levels, often below the limits of detection of hydrocarbons and oxides of nitrogen using mass spectroscopic techniques.

The combustor 25 represents a mechanism for using heat and water to create a high temperature working fluid without the inefficiencies that result when the heat must be transmitted through a heat exchanger to a flash vaporizer or a boiler. The addition of water rather than merely heated gas to the products of combustion represents a means for using a fluid source for gas, water flashing to steam which provides a very efficient source of mass and pressure and at the same time gives tremendous flexibility in terms of temperature, volume, and the other factors which can be controlled independently. An additional degree of freedom is created by the addition of water. Injected water, when added during the combustion process, or to quench the combustion process, greatly reduces contamination that results from most combustion processes.

There is only about 30% as much nitrogen in the combusted gases of the combustion chamber 25 when compared to a normal air dilution open cycle Brayton engine of any form or model because water rather than excess air is used for cooling and the amount of air fed to the system is thus greatly reduced. Water cyclonically expands as it forms steam, and creates a molecular activity unsurpassed in controlled internal combustion.

3. Water Injection

Water injection control 40 controls the injection of water 41 through nozzles, arranged for spraying a fine mist of water in the chamber. Water may be injected into an engine in one or more areas, including: atomized into intake air before compressor 10 sprayed into the compressed air stream generated by compressor 10; atomized around or within the fuel nozzle or a multiplicity of fuel nozzles; atomized into the combustion flame in combustion chamber 25, or into the combustion gases at any desired pressure; or downstream into the combustion gases prior to their passage into work engine 50. Other areas can be readily envisioned by the skilled artisan. As described earlier, the amount of water injected is based on the temperature of the combustion products as monitored by thermostats in combustion chamber 25. The amount of water injected is also dependent on the system using the VAST cycle. For example, if the water is recycled as for use in a motor vehicle, the water is cooled as much as possible to obtain a usable balance between total water used and power output, i.e., if the inlet water temperature is low and the TIT is high a small volume of water can be used to reduce the combustion temperature to the TIT. On the other hand, if a major purpose of the system is to produce potable water from salt water, as discussed below, while generating electrical energy, the water inlet temperature would be raised as high as possible while the TIT is lowered.

C. Other Embodiments Of Present Invention

1. Power Plant Including Water Desalination

Figure 4:
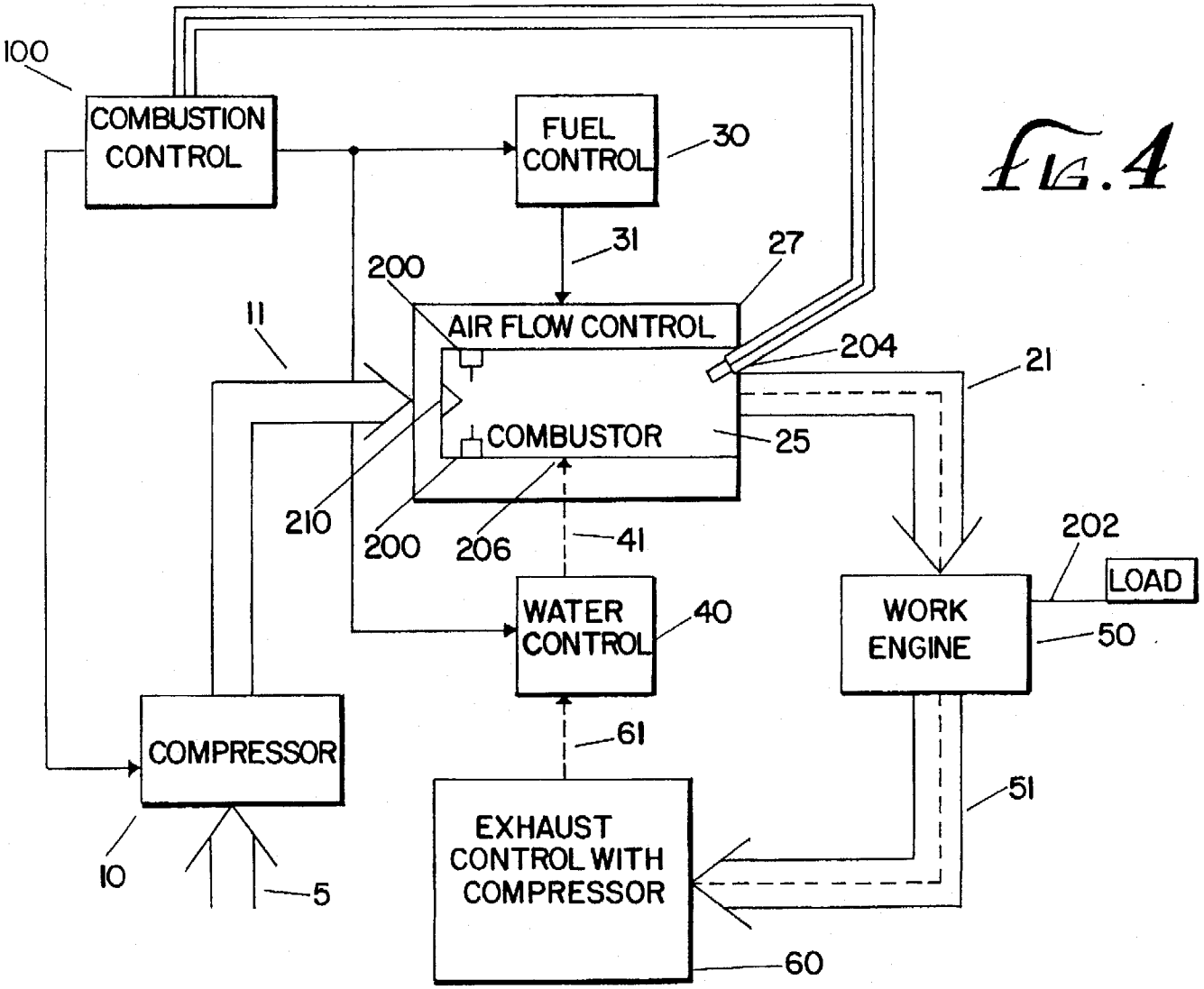
FIG. 4 is a block diagram of a vapor-air steam turbine engine that includes means for desalinating seawater to obtain potable water in accordance with the present invention.
Figure 5:
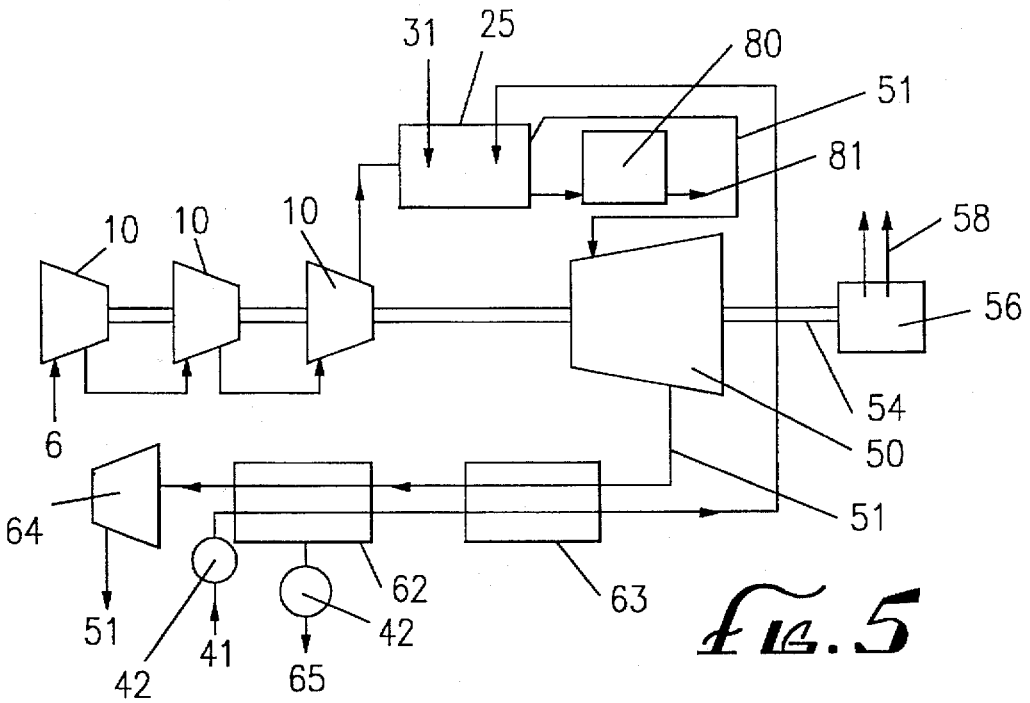
FIG. 5 is a schematic drawing of one embodiment of the vapor-air steam turbine engine shown by a block diagram in FIG. 4.

In the case of electric power generation using sea water as a coolant, the cycle is open as to air and electric power, and the water used as shown in FIGS. 4 and 5. Seawater 41, moved by pump 42, is heated as it passes through condenser 62 and heat exchanger 63 countercurrent to exiting hot working fluid 51 and is flash vaporized in a larger version of combustion chamber 25 described above. Increasing the diameter of the combustion chamber also reduces the velocity of the working fluid in order to ensure better salt removal.

The typical temperature of operation of the combustor (1500° F. to 2300° F.) is above the melting point but significantly below the boiling point of the salts in sea water (85% of sea salt is NaCl; an additional 14% is composed of $MgCl_2$, $MgSO_4$, $CaCl_2$ and KCl). Therefore, when the sea water flashes to steam the salts rain out as a liquid. For example, NaCl melts at 1473° F. and boils at 2575° F., the other salts have lower melting points and higher boiling points. As a result the molten salts are readily collected along the bottom wall of the combustor and the liquid salts can be removed by a screw assembly on the bottom of the combustor, fed through an extruder and die where it can be formed into rods or pellets, or sprayed through nozzles, using the pressure in the combustor as the driving force, into a cooling chamber where it can be deposited as flakes, powder, or pellets of any desired size or shape by selection of the proper spray nozzle dimensions and configuration. Because the salt water is exposed to extremely high temperatures in the combustion chamber the salt recovered is sterile and free of organic matter.

Water on the order of 6 to 12 times fuel by weight is atomized into the combustion flame and vaporized in milliseconds. Salt or impurities entrained in the steam are separated from steam by crystallization, precipitation and/or filtering until the steam is pure.

Salt collection and removal mechanism 80 can be accomplished by any of a number of well-known means from combustion chamber 25, such as by a rotary longitudinal auger. This auger is sealed as not to bypass much pressurized working gases as it rotates and removes the precipitated salt. As mentioned above, an alternative is to spray the molten salt through spray nozzles into a collecting tower or extrude the salt 81 into strands or rods which can then be cut to desired sizes. A still further alternative is to drain the molten salt directly into molds to form salt blocks 81 which are then easy to transport and use in chemical processing.

The resulting working fluid, which now includes pure water steam, may be used in a standard steam turbine or a multiplicity of turbines. Following work production by the expanding steam-gas mixture, a condenser 62 condenses steam 61 resulting in a source of usable potable water 65. Using this open cycle at pressure ratios of 10:1 or 50:1 or higher electric power may be generated at good efficiencies and specific fuel consumption.

Figure 6:
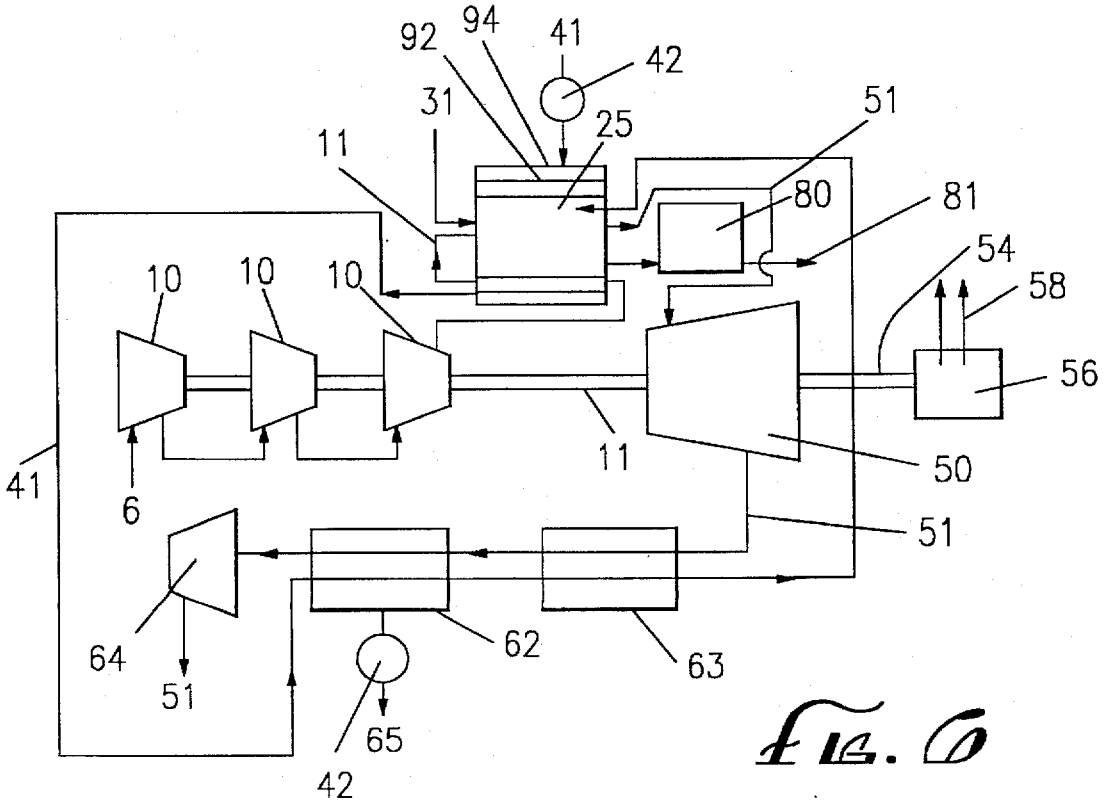
FIG. 6 is a schematic drawing of a second embodiment of a vapor-air steam turbine engine with desalination capabilities incorporating features of the invention.
Figure 7:
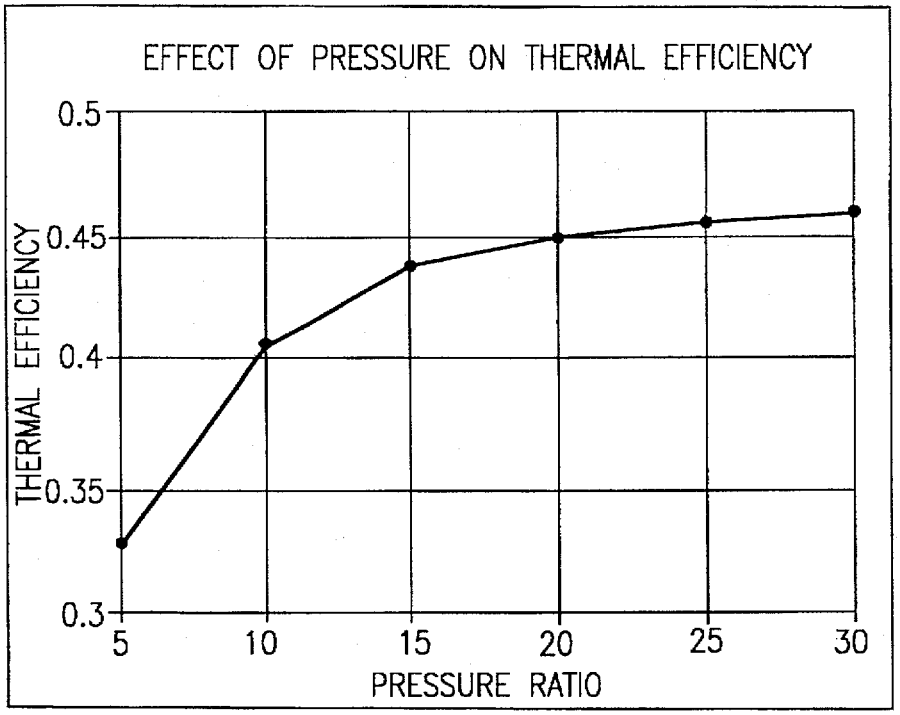
FIG. 7 is a graph showing the effect of pressure ratio on thermal efficiency for the vapor-air steam turbine engine of FIG. 1.
Figure 8:
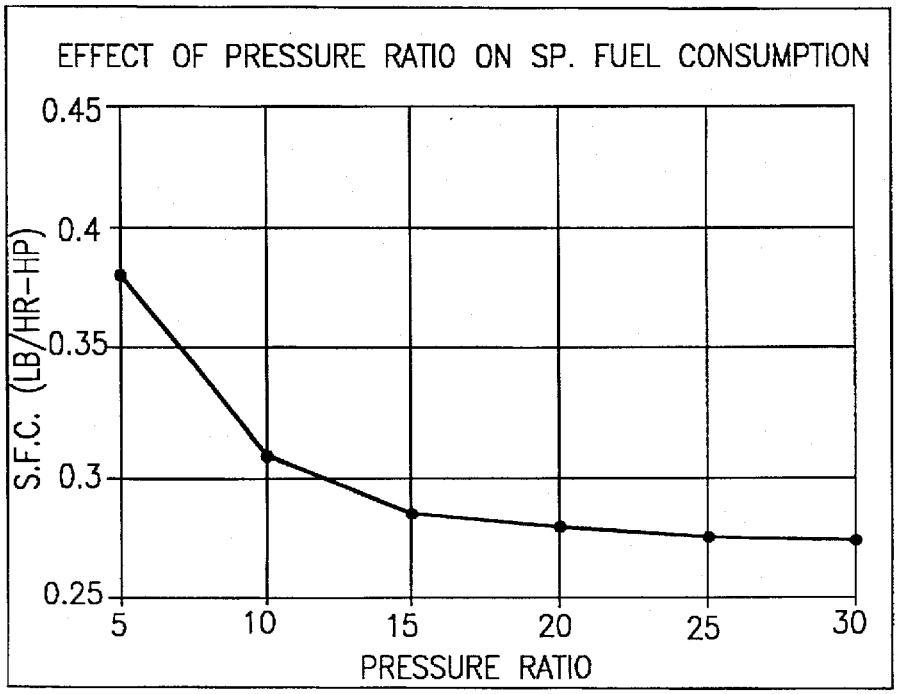
FIG. 8 is a graph showing the effect of effect of pressure ratio on specific fuel consumption for the vapor-air steam turbine engine of FIG. 1.
Figure 9:
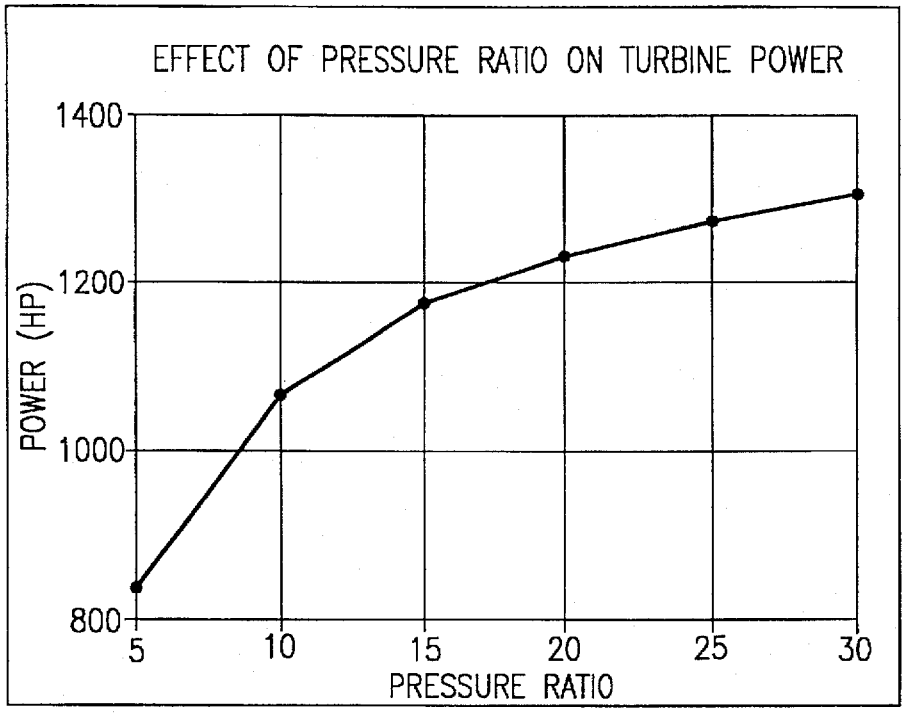
FIG. 9 is a graph showing the pressure ratio on turbine power for the vapor-air steam turbine engine of FIG. 1.
Figure 10:
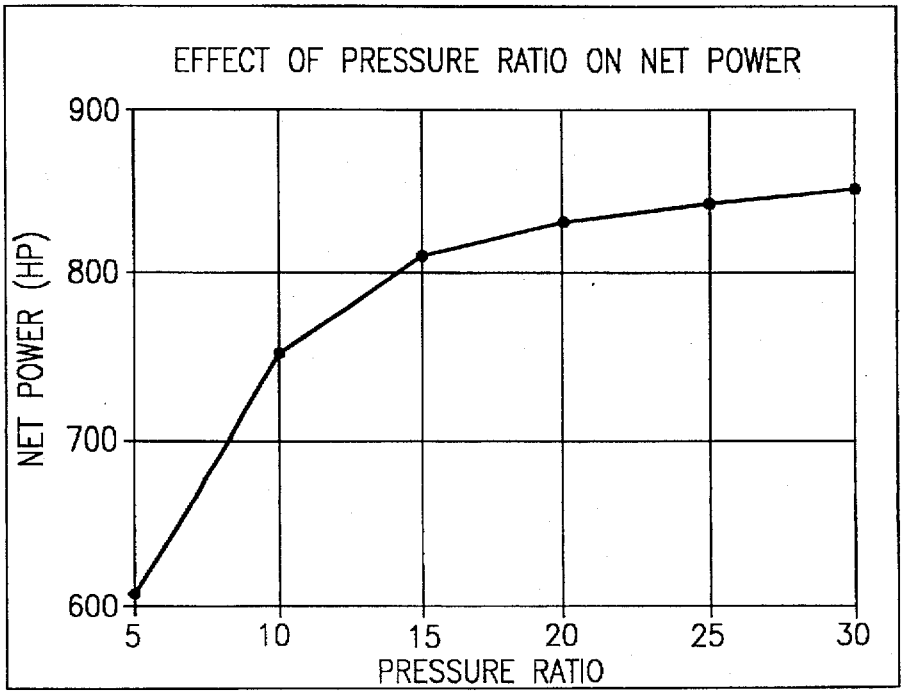
FIG. 10 is a graph of the effect of pressure ratio on net power for the vapor-air steam turbine engine of FIG. 1.

FIG. 6 shows a second embodiment of a desalination unit using the VAST cycle. In this embodiment, the efficiency of the system is further increased by capturing additional waste heat from the combustion chamber 25. The combustion chamber 25 is enclosed in a double shell heat exchanger 90. In the version shown the hot compressed air 11 exiting the compressor 10 passes through the shell 92 immediately surrounding the combustion chamber 25 before it enters the combustor 25. The cold sea water 41 is fed to a second shell 94 which surrounds the first shell 92. In this manner the air 11 absorbs additional heat normally lost from the combustor 25 and the incoming sea water 41 absorbs some of the heat from the compressed air 11. An additional benefit, since the air 11 is at an elevated pressure, is that the pressure differential across the combustion chamber 25 wall (i.e. the difference between the combustor interior and ambient conditions as in FIG. 5 or the difference between the combustor interior and the compressed air 11) is significantly reduced, thus reducing the stress on the combustor wall from the combination of high temperature and high pressure. The sea water 41 after passing through the combustion chamber outer shell 94 then proceeds through the condenser 62 and the heat exchanger 73 to acquire the desired injection temperature. Care is taken to maintain the water under pressure possibly as high as 4000 psi so that, as the water is heated, it does not convert to steam until it is injected into the combustion chamber 25 which is at a higher temperature and, in most instances, a lower pressure than the superheated sea water 41.

Purification of contaminated waste products, treatment of solid, liquid and gaseous waste products from commercial processes resulting in useable products with power production as a by-product are also potential applications of an engine employing the VAST cycle. Waste water from dried solid waste products may be used in the present invention, resulting in filtered, useable water as one byproduct. The combustible materials are additional fuel for burning in the combustor 25 and the inorganic dried waste products may then be used to create fertilizers. As is apparent, other chemicals can be extracted from solid and liquid products using the present invention. Sewage treatment is also an application. Other applications include water softening, steam source in conjunction with oil field drilling operations and well production, recovery and recycling of irrigation water along with fertilizer and minerals leached from the soil, etc.

2. Hybrid Brayton and VAST cycle

Another embodiment of the present invention utilizes a hybrid Brayton-VAST cycle. Basically, in operations in excess of 20,000 rpm, water injection is constant in an amount approximately equal to fuel in weight, while the portion of compressed air combusted proportionately decreases as engine rpm increases. Below, 20,000 rpm, water injection and the portion of compressed air combusted are proportionately increased. At a cross-over between 20,000 to 10,000 for example, the portion of compressed air combusted increases from approximately 25% to 95%. Below 10,000, the amount of combusted air is held constant, while the amount of water injection increases to a level equal to 7 to 12 times the weight of fuel.

Thus, a Brayton Cycle is employed in the top half operating from twenty thousand rpm up to a maximum of about forty five thousand rpm or more. The lower half of the process employs a VAST Cycle of internally cooling with water. Crossover occurs at 20,000 rpm where a normal Brayton Cycle begins to lose power. The crossover continues over the range of 20,000 to 10,000 rpm. At 10,000 rpm the engine is purely a VAST Cycle, fully cooled by water.

In such a system, horsepower is multiplied by a factor of three plus to one as rpm decreases from 20,000 to 10,000 because as the engine converts from Brayton to VAST at 20,000 rpm it cuts back on air dilution and adds more water for cooling. Below 10,000 rpm the engine operates on VAST only, cooling via water and combusting at least about 95% of the compressed air. Some advantages are the increased horsepower, low rpm, slow idle, fast acceleration and combustion of substantially all of the compressed air with complete pollution control at all levels of rpm.

3. Aircraft Engines

The VAST cycle described about, particularly when operated with recycled water, is particularly efficient and has a relatively low fuel consumption when used in commercial air craft which normally operates at 30,000 to 40,000 feet. At such elevations ambient pressure is 0.1 to 0.25 atmospheres or lower and ambient temperature is well below 0° F. Examples 6–8 illustrate the benefit of lowering turbine exit pressure. However, to generate turbine exit pressures below atmosphere, such as when operating the system at sea level, a vacuum pump on the turbine exit is necessary. This pump, which consumes energy generated by the system, reduces the usable energy and efficiency of the system. Irrespective of taking into consideration the energy consumed by the vacuum pump, horsepower and efficiency of the system is increased and fuel consumption is reduced.

Elimination of the turbine exit vacuum pump by operating in an environment with pressures less that atmosphere, such as at elevations greater than about 30,000 feet, increases the usable power output of the system, and therefore, reduces fuel consumption. Further, if the water in the system is to be recycled, the ambient air temperature can be used to condense and cool the exiting gas stream and separate the water for recycling.

D. Data tables

Listed below are data tables containing detailed information on the performance of an engine designed in accordance with the teachings of the present invention. These data tables were generated using a computer simulation program.

Certain abbreviations used in the table include:

f/a ratio=fuel to air ratio turbine exit pressure=1 (atmospheres)

gamma compr.=$\Gamma=C_p/C_v$

All temperatures are in Rankin=(R)

cpmix=mixed $C_p$ for air+steam sfc=specific fuel consumption eff=efficiency

The example in the data table at a pressure ratio of 22:1 is Example 1 in Table 1 above. The text of the computer program used for simulating operation of the engine specified that the water inlet temperature was 212° F. (672° R.), the TIT was 1800° F. (2260° R.), the temperature entering the first compressor stage was 60° F. (520° R.) and each compressor stage and the turbine operated at an 85% efficiency.

VAST CYCLE OPERATED AT PRESSURE RATIO OF 10:1 f/a ratio=0.066

Pressure Ratio=10.000

Number of Compression Stages=3

Inlet Water Temperature=672.000° R.

Turbine Exit Pressure=1.000

1 lb/s of air with Turbine Inlet Temp. (R)=2260.000 gamma compr. 1=1.395088723469110 583.127002349018800 gamma compr. 2=1.393245781855153 749.390666288273000 gamma compr. 3=1.382644396697381 960.403717287130800

CPGAS in the burner=3.048731265150463E-001 1678.944055 144487000

Comp. Inlet Temp, T1=520.00

1st Stage Outlet Temp, T2d (R)=668.53

2nd Stage Outlet Temp, T3D (R)=858.78

3rd Stage Outlet Temp, T4d (R)=1097.89

Mass Flow Rate of Water (lb/s),=0.442 gamma in turbine=1.274667679410808 1818.01300684155 9000 cpmix in the turbine=3.894133323049679E-001 1818.013006 841559000 partial press. of steam (atm)=5.885070348102550 partial press. of air (atm)=8.814929461162587

SAT. TEMP. AT TURBINE OUTLET (R)= 591.701098285192200 gamma in sec. comp=1.346058430899532 633.271250898951 400 cpmix in SEC. COMP=3.253198837676842E-001 633.2712508 98951400

Turbine Inlet Temp., TS (R)=2260.00

Turbine Exit Temp., T6D(R)=1508.62

Temp. drop across Turbine, DT=751.38

HP TURBINE=624.28

HPCOMP=199.735

TOTAL MASS FLOW RATE (lb/s)=1.5077

NET HP (open cycle)=424.54 sfc (open cycle)=0.560 eff(open cycle=0.234

T7=674.84

T7D=689.51

DT COMP. 2=97.81

HP COMP. 2=48.00

HP water pump=0.017

NET HP (closed cycle)=376.53 sfc (closed cycle)=0.631 eff2 (closed cycle)=0.208 composition of exhaust by volume

% of CO2=10.8

% of H2O=25.8

% of N2=63.4

VAST CYCLE OPERATED AT PRESSURE RATIO OF 22:1 f/a ratio=0.066

Pressure Ratio=22.000

Number of Compression Stages=3

Inlet Water Temperature=672.000

Turbine Exit Pressure=1.000

1 lb/s of air with Turbine Inlet Temp. (R)=2260.000 gamma compr. 1=1.394809521089263 608.043650004366800 gamma compr. 2=1.392157497682254 849.596261682560700 gamma compr. 3=1.369677999652017 1177.990796008891000

CPGAS in the burner=3.101676106439402E-001 1829.089319 349098000

Comp. Inlet Temp, T1=520.00

1st Stage Outlet Temp, T2d (R)=727.16
2nd Stage Outlet Temp, T3D (R)=1015.24
3rd Stage Outlet Temp, T4d (R)=1398.18
Mass Flow Rate of Water (lb/s),=0.505
gamma in turbine=1.278767591503703 1706.015578042335000
cpmix in the turbine=3.906654117917358E-001 1706.015578 042335000
partial press. of steam (atm)=6.361387976418345
partial press. of air (atm)=8.338611832846791
SAT. TEMP. AT TURBINE OUTLET (R)= 593.171968080811400
gamma in sec. comp=1.344309728848165 639.522982616262 100
cpmix in SEC. COMP=3.316760835964486E-001 639.5229826 16262100
Turbine Inlet Temp., T5 (R)=2260.00
Turbine Exit Temp., T6D(R)=1318.23
Temp. drop across Turbine, DT=941.77
HP TURBINE=817.80
HPCOMP=308.108
TOTAL MASS FLOW RATE (lb/s)=1.5708
NET HP (open cycle)=509.69
sfc (open cycle)=0.466
eff(open cycle)=0.281
T7=685.87
T7D=702.23
DT COMP. 2=109.06
HP COMP. 2=54.57
HP water pump=0.018
NET HP (closed cycle)=455.11
sfc (closed cycle)=0.522
eff2 (closed cycle)=0.251
composition of exhaust by volume
% of CO2=10.8
% of H2O=25.8
% of N2=63.4

VAST CYCLE OPERATED AT PRESSURE RATIO OF 30:1 f/a ratio=0.066
Pressure Ratio=30.000
Number of Compression Stages=3
Inlet Water Temperature=672.000
Turbine Exit Pressure=1.000
1lb/s of air with Turbine Inlet Temp. (R)=2260.000
gamma compr. 1=1.394694290256902 618.355140835066100
gamma compr. 2=1.389029752150665 891.837744705560000
gamma compr. 3=1.366209070734794 1273.898681933465000
CPGAS in the burner=3.124320900049776E-001 1896.892037 142618000
Comp. Inlet Temp, T1=520.00
1st Stage Outlet Temp, T2d (R)=751.42
2nd Stage Outlet Temp, T3D (R)=1081.81
3rd Stage Outlet Temp, T4d (R)=1533.78
Mass Flow Rate of Water (lb/s),=0.534
gamma in turbine=1.280208955027821 1666.747232151006000
cpmix in the turbine=3.916002625082443E-001 1666.747232 151006000
partial press. of steam (atm)=6.562762207406494
partial press. of air (atm)=8.137237601858644
SAT. TEMP. AT TURBINE OUTLET (R)= 593.793812111702800
gamma in sec. comp=1.343572354850198 642.266214292339 600
cpmix in SEC. COMP=3.344248062769462E-001 642.2662142 92339600
Turbine Inlet Temp., T5 (R)=2260.00
Turbine Exit Temp., T6D(R)=1251.47
Temp. drop across Turbine, DT=1008.53
HP TURBINE=894.00
HPCOMP=358.471
TOTAL MASS FLOW RATE (lb/s) 1.5996
NET HP (open cycle)=535.53
sfc (open cycle) 0.444
eff(open cycle=0.296
T7=690.74
T7D=707.85
DT COMP. 2=114.05
HP COMP. 2=57.54
HP water pump=0.019
NET HP (closed cycle) 477.97
sfc (closed cycle)=0.497
eff2 (closed cycle)=0.264
composition of exhaust by volume
% of CO2=10.8
% of H2O=25.8
% of N2=63.4

VAST CYCLE OPERATED AT PRESSURE RATIO OF 40:1 f/a ratio=0.066
Pressure Ratio=40.000
Number of Compression Stages=3
Inlet Water Temperature=672.000
Turbine Exit Pressure=1.000
1lb/s of air with Turbine Inlet Temp. (R)=2260.000
gamma compr. 1=1.394584582122682 628.187703506602900
gamma compr. 2=1.385229573509871 932.452934382434300
gamma compr. 3=1.360860939314250 1366.979659174880000
CPGAS in the burner=3.145343519546454E-001 1962.926186 235099000
Comp. Inlet Temp, T1=520.00
1st Stage Outlet Temp, T2d (R)=774.56
2nd Stage Outlet Temp, T3D (R)=1146.07
3rd Stage Outlet Temp, T4d (R)=1665.85
Mass Flow Rate of Water (lb/s),=0.562
gamma in turbine=1.281335192214647 1632.717036740625000 cpmix in the turbine=3.925796903477528E-001 1632.717036 740625000 partial press. of steam (atm)=6.750831994487843 partial press. of air (atm)=7.949167814777294

SAT. TEMP. AT TURBINE OUTLET (R)= 594.374571993012600 gamma in sec. comp=1.342884542206362 644.886243238150 400 cpmix in SEC. COMP=3.370260274627372E-001 644.8862432 38150400

Turbine Inlet Temp., T5 (R)=2260.00

Turbine Exit Temp., T6D(R)=1193.62

Temp. drop across Turbine, DT=1066.38

HP TURBINE=964.40

HPCOMP=408.011

TOTAL MASS FLOW RATE (lb/s)=1.6279

NET HP (open cycle)=556.38 sfc (open cycle)=0.427 eff(open cycle=0.307

T7=695.40

T7D=713.23

DT COMP. 2=118.85

HP COMP. 2=60.42

HP water pump=0.019

NET HP (closed cycle)=495.94 sfc (closed cycle)=0.479 eff2 (closed cycle)=0.274 composition of exhaust by volume

% of CO2=10.8

% of H2O=25.8

% of N2=63.4

VAST CYCLE OPERATED AT PRESSURE RATIO OF 50:1 f/a ratio=0.066

Pressure Ratio=50.000

Number of Compression Stages=3

Inlet Water Temperature=672.000

Turbine Exit Pressure=1.000

1lb/s of air with Turbine Inlet Temp. (R)=2260.000 gamma compr. 1=1.394497572254039 635.996556562169400 gamma compr. 2=1.382215305172556 965.068507644903400 gamma compr. 3=1.356615282102378 1442.860640297455000

CPGAS in the burner=3.162590285087881E-001 2017.100000 649888000

Comp. Inlet Temp, T1=520.00

1st Stage Outlet Temp, T2d (R)=792.93

2nd Stage Outlet Temp, T3D (R)=1197.96

3rd Stage Outlet Temp, T4d (R)=1774.20

Mass Flow Rate of Water (lb/s), 0.585 gamma in turbine=1.282120028863920 1607.786622664966000 cpmix in the turbine=3.934720408020952E-001 1607.786622 664966000 partial press. of steam (atm)=6.900293693691603 partial press. of air (atm)=7.799706115573533

SAT. TEMP. AT TURBINE OUTLET (R)= 594.836110021193700 gamma in sec. comp=1.342338420102895 647.010415983017 100 cpmix in SEC. COMP=3.391172383199348E-001 647.0104159 83017100

Turbine Inlet Temp., TS (R)=2260.00

Turbine Exit Temp., T6D(R)=1151.24

Temp. drop across Turbine, DT=1108.76

HP TURBINE=1019.48

HPCOMP—449.150.

TOTAL MASS FLOW RATE (lb/s)=1.6514

NET HP (open cycle) 570.33 sfc (open cycle) 0.417 eff(open cycle=0.315

T7=699.18

T7D=717.60

DT COMP. 2=122.76

HP COMP. 2=62.80

HP water pump—0.020

NET HP (closed cycle)=507.53 sfc (closed cycle)=0.468 eff2 (closed cycle)=0.280 composition of exhaust by volume

% of CO2=10.8

% of $H_2O$=25.8

% of N2=63.4

TEXT OF COMPUTER PROGRAM USED FOR SIMULATING OPERATION OF ENGINE EMPLOYING PRESENT INVENTION

```
IMPLICIT REAL*8(A-H,O--Z)
DIMENSION PAIR(17),TT(17),VAIR(17),vn2(17),pn2(17),
     *     pco2(17),vco2(17),ph20(17),vh20(17)
open(unit=11,file='1')
open(unit=22,file='2')
open(unit=33,file='3')
open(unit=44,file='4')
open(unit=1,file='al')
DO 5 I=1,17
READ(11,*)TT(I),PAIR(I),VAIR(I)
read(22,*)tt(i),pn2(i),vn2(i)
read(33,*)tt(i),ph20(i),vh20(i)
read(44,*)tt(i),pco2(i),vco2(i)
TT(I)=TT(I)+460.0
5          CONTINUE
```

42

```
FA=0.066
READ(*,*)PR
ns=3
write(*,*)'turbine exit pressure=?'
read(*,*)pt
twater=212.d0+460.d0
tit=2260.0d0
write(1,555) fa, pr, ns ,twater, pt ,tit
555            format(5x,'f/a  ratio  =',  3x,f7.3,/,  Sx,
'Pressure Ratio =',3x,
     *     f7.3, /, Sx, 'Number of Compression Stages=',
i4,/
     *     , Sx, ' Inlet Water Temperature=', f7.3,/,
     *       Sx, ' Turbine Exit Pressure=', f7.3,/
     *    ,Sx, ' 1 lb/s of air with Turbine Inlet Temp.
(R)= ', f8.3
     * ,/,/,/)
T1=520.DO
PRS=(PR)**(1.DO/FLOAT(NS))
COMPRESSOR 1
GA=1.4
DO 10 I=1,10
WRITE(*,*)'gamma compr. 1=', ga,tav
T2=T1*(PRS)**((GA-1.0)/GA)
TAV=(T1+T2)/2.DO
GA=CpAIR(TAV,pair,vair,tt)/CVAIR(TAV,pair,vair,tt)
ga=1.406
10         CONTINUE
WRITE(1,*)'gamma compr. 1=', ga,tav
T2D=T1+(T2-T1)/0.85
HPC1=1.0*(T2D-T1)*CpAIR(TAV,PAIR,VAIR,TT)*778.3/550.0
COMPRESSOR 2
GA=1.4
```

PCT/US 93/10280

```
DO 20 I=1,10
T3=T2D*(PRS)**((GA-1.0)/GA)
TAV=(T3+T2D)/2.DO
GA=CpAIR(TAV,pair,vair,tt)/CVAIR(TAV,pair,vair,tt)
cga=1.406
20        CONTINUE
write(1,*)'gamma compr. 2=', ga,tav
T3D=T2d+(T3-T2D)/0.85
HPC2=1.0*(T3D-T2D)*CpAIR(TAV,PAIR,VAIR,TT)*778.3/550.0
HPC=HPC1+HPC2
C         COMPRESSOR 3
GA=1.4
DO 25 I=1,10
T4=T3D*(PRS)**((GA-1.0)/GA)
TAV=(T4+T3D)/2.DO
GA=CpAIR(TAV,pair,vair,tt)/CVAIR(TAV,pair,vair,tt)
c          ga=1.406
25        CONTINUE
write(1,*)'gamma compr. 3=', ga,tav
T4D=T3d+(T4-T3D)/0.85
HPC3=1.0*(T4D-T3D)*CpAIR(TAV,PAIR,VAIR,TT)*778.3/550.0
HPC=HPC1+HPC2+hpc3
BURNER
tav=(t4d+2260.d0)/2.0
TBURN=FA/0.066*3600.DO+T4D
a1=CpCo2(tav,pco2,vco2,tt)
a2=cpn2(tav,pn2,vn2,tt)
a3=cph20(tav,ph20,vh20,tt)
write(*,*)tav,cpgas,a1,a2,a3
cpgas=(352.0*a1+162.0*a3+1263.36*a2)/1777.36
WRITE(1,*)'CPGAS in the burner=', cpgas,tav
WRITE(*,*)CPGAS
```

44

```
AMW=(TBURN-460.D0-1800.DO)*(1.DO+FA)*cpgas/(1973.6-180.0)
amt=1.dO+amw+fa
WRITE(1,100)T1,T2D,T3D,t4d,amw
FORMAT('Comp. Inlet Temp, T1=',5X,F7.2,/,
       '1 st Stage Outlet Temp, T2d (R)=',5X,F7.2,/,
       '2 nd Stage Outlet Temp, T3D (R)=',5X,F7.2,
/, '3 rd Stage Outlet Temp, T4d (R)=',5X,F7.2,/,
       'Mass Flow Rate of Water (lb/s), =',5x,f7.3,/)
turbine
t5=2260.DO
GA=1.4
DO 30 I=1,10
T6=T5*(pt/PR)**((GA-1.O)/GA)
TAV=(T5+T6)/2.DO
a1=cpco2(tav,pco2,vco2,tt)
a2=cpn2(tav,pn2,vn2,tt)
a3=cph20(tav,ph20,vh20,tt)
cpgas=(352.0*a1+162.0*a3+1263.36*a2)/1777.36
CpMIX=(AMW*A3+(1.DO+FA)*CPGAS)/(AMT)
c          WRITE(*,*)'CPMIX=',CPMIX
a1=cVco2(tav,pco2,vco2,tt)
a2=cVn2(tav,pn2,vn2,tt)
a3=cVh20(tav,ph20,vh20,tt)
cVgas=(352.O*a1+162.O*a3+1263.36*a2)/1777.36
CVMIX=(AMW*A3+(1.DO+FA)*CVGAS)/(AMT)

GA=CPMIX/CVMIX
CONTINUE
write(1,*)'gamma in turbine=', ga,tav
write(1,*)'cpmix in the turbine=', cpmix,tav
T6D=TS+(T6-T5)*0.85
DTT=TS-T6D
HPT=AMT*DTT*778.3/550.0*Cpmix
```

PCT/US 93/10280

45

```
        HPN1=HPT-HPC
SFC1=FA*3600.DO/HPN1
EFF1=HPN1*550.D0/778.3/(3600.0*0.328+180.DO*O.SS)
go to 1100
SECONDARY COMPRESSOR
PP=pt*14.7*(aMW/18.0)/(aMW/18.0+(1.DO+FA)/29.0)
pa=pt*14.7-pp
write(1,*)'partial press. of steam (atm)=', pp
write(1,*)'partial press. of air   (atm)=', pa
HPpump=amw*(1.dOS-pp/14.7*1.dOS)/1.dO3*1.04/2.2/746
SAT=TSAT(PP)+460.0
        write ( 1, * ) ' SAT . TEMP . AT TURBINE OUTLET
(R) = ', SAT
        GA=1.4
        DO 70 I=1,10
        T7=sat*(14.7/Pa)**((GA-1)/GA)
        TAV=(T7+sat)/2.DO
        write(*,*)'gamma in sec. comp =', ga,tav
        write ( *, * ) ' cpmix in SEC . COMP = ', cpmix,
tav
        write(*,*)'t6,sat=', t7,sat
        a1=cpco2(tav,pco2,vco2,tt)
        a2=cpn2(tav,pn2,vn2,tt)
        a3=cph20(tav,ph2c,vh20,tt)
        cpgas=(352.0*a1+162.0*a3+1263.36*a2)/1777.36
        CPMIX=(AMW*A3+(1.DO+FA)*CPGAS)/(AMT)
        WRITE ( *, * ) ' CPMIX= ', CPMIX
 a1=cVco2(tav,pco2,vco2,tt)
 a2=cVn2(tav,pn2,vn2,tt)
 a3=cVh20(tav,ph20,vh20,tt)
 cVgas=(352.0*a1+162.0*a3+1263.36*a2)/1777.36
 CVMIX=(AMW*A3+(1.DO+FA)*CVGAS)/(AMT)
 GA=CPMIX/CVMIX
```

```
70          CONTINUE
 write(1,*)'gamma in sec. comp =', ga,tav
 write(1,*)'cpmix in SEC. COMP =', cpmix,tav
 T7D=(T7-sat)/0.85+sat
 DTT1=t7d-sat
 HPS=(1.d0+fa)*DTT1*778.3/550.0*CpMIX
 HPN2=HPT-HPC-HPS-hppump
 SFC2=FA*3600.D0/HPN2
 EFF2=HPN2*550.D0/778.3/(3600.0*0.328+180.D0*0.55)
 write(1,*)
 write(1,*)
1           1           0           0
WRITE(1,200)T5,T6D,DTT,HPT,HPC,AMT,HPN1,SFC1,eff1
200                 FORMAT('Turbine  Inlet  Temp.,  T5
(R)=',SX,F7.2,/,
      * 'Turbine Exit Temp., T6D(R)=',5X,F7.2,
      *    /, 'Temp. drop across Turbine, DT=',5X,F7.2,/,
      * 'HP TURBINE=',5X,F7.2,/,'HPCOMP
      *      =',5x,f7.3,/,'TOTAL  MASS  FLOW  RATE  (lb/s)
=',5X,F6.4,/,
      *    'NET HP (open cycle) = ',5X,F7.2,/
      *    , ' sfc (open cycle) = ', 5X, F7.3,/,
      *      'eff(open cycle=',5x,f7.3,/,/)
 WRITE(1,400)T7,T7D,DTT1,HPS,hppump,HPN2,SFC2,eff2
400         FORMAT('T7=',5X,F7.2,/,'T7D=',5X,F7.2,
      *       /,'DT  COMP.  2  =',5X,F7.2,/,'HP  COMP.  2
=',5X,F7.2,/,
      *     ' HP water pump =', f7.3,/
      *    ,'NET HP (closed cycle) = ',5X,F7.2,/
      *    , ' sfc (closed cycle) = ', 5X, F7.3,/,
      *      'eff2 (closed cycle) =',5x,f7.3,/,/,/)
 write(1,*)'composition of exhaust by volume'
 write(1,*)' -
```

47

```
Write(1,*)'% of C02= 10.8'
Write(1,*)'% of H20= 25.8'
Write(1,*)'% of N2 = 63.4'
 STOP
 END
 alr
 FUNCTION CPAIR(TAV,pair,vair,tt)
 IMPLICIT REAL*8(A-H,O-Z)
 DIMENSION PAIR(17),TT(17),VAIR(17)
  COMMON PAIR,TT,VAIR,vn2,cn2,vh20,ph20,vco2,pco2
 DO 10 I=1,16
 IF(TAV.LE.TT(I+1).AND.TAV.GE.TT(I))THEN

CPAIR=PAIR(I)+(TAV-TT(I))*(PAIR(I+1)-PAIR(I))/(TT(I+1)-T
T(I))
 GO TO 999
ENDIF
10        CONTINUE
999       S=CPAIR
RETURN
END
FUNCTION CVAIR(TAV,pair,vair,tt)
IMPLICIT REAL*8(A-H,O-Z)
DIMENSION PAIR(17),TT(17),VAIR(17)
c         COMMON PAIR,TT,VAIR,vn2,cn2,vh20,ph20,vco2,pco2
DO 10 I=1,16
IF(TAV.LE.TT(I+1).AND.TAV.GE.TT(I))THEN
CVAIR=VAIR(I)+(TAV-TT(I))*(VAIR(I+1)-VAIR(I))/(TT(I+1)-T
T(I))
GO TO 999
ENDIF
10        CONTINUE
999       S=CPAIR
```

48

```
RETURN
END
FUNCTION CPn2(TAV,pn2,vn2,tt)
IMPLICIT REAL*8(A-H,O-Z)
DIMENSION Pn2(17),TT(17),Vn2(17)
c         COMMON PAIR,TT,VAIR,vn2,cn2,vh20,ph20,vco2,pco2
DO 10 I=1,16
IF(TAV.LE.TT(I+1).AND.TAV.GE.TT(I))THEN
CPn2=Pn2(I)+(TAV-TT(I))*(Pn2(I+1)-Pn2(I))/(TT(I+1)-TT(I))
GO TO 999
ENDIF
10        CONTINUE
999       S=CPn2
RETURN
END
FUNCTION CVn2(TAV,pn2,vn2,tt)
IMPLICIT REAL*8(A-H,O-Z)
DIMENSION Pn2(17),TT(17),Vn2(17)
c         COMMON PAIR,TT,VAIR,vn2,cn2,vh20,ph20,vco2,pco2
DO 10 I=1,16
IF(TAV.LE.TT(I+1).AND.TAV.GE.TT(I))THEN
CVn2=Vn2(I)+(TAV-TT(I))*(Vn2(I+1)-Vn2(I))/(TT(I+1)-TT(I))
GO TO 999
ENDIF
10        CONTINUE
999       S=CVn2
return
END

   h20
FUNCTION CPh20(TAV,ph20,vh20,tt)
IMPLICIT REAL*8(A-H,O-Z)
DIMENSION Ph20(17),TT(17),Vh20(17)
```

PCT/US 97/10200

```
c          COMMON PAIR,TT,VAIR,vn2,cn2,vh20,ph20,vco2,pco2
DO 10 I=1,16
IF(TAV.LE.TT(I+1).AND.TAV.GE.TT(I))THEN
CPh20=Ph20(I)+(TAV-TT(I))*(Ph20(I+1)-Ph20(I))/(TT(I+1)-T
T(I))
GO TO 999
ENDIF
10         CONTINUE
999        S=CPh20
RETURN
END
FUNCTION CVh20(TAV,ph20,vh20,tt)
IMPLICIT REAL*8(A-H,O-Z)
DIMENSION Ph20(17),TT(17),Vh20(17)
c          COMMON PAIR,TT,VAIR,vn2,cn2,vh20,ph20 vco2,pco2
DO 10 I=1,16
IF(TAV.LE.TT(I+1).AND.TAV.GE.TT(I))THEN
CVh20=Vh20(I)+(TAV-TT(I))*(Vh20(I+1)-Vh20(I))/(TT(I+1)-T
T(I))
GO TO 999
ENDIF
10         CONTINUE
999        S=CVh20
RETURN
END
 co2
FUNCTION CPco2(TAV,pco2,vco2,tt)
IMPLICIT REAL*8(A-H,O-Z)
DIMENSION Pco2(17),TT(17),Vco2(17)
c          COMMON PAIR,TT,VAIR,vn2,cn2,vh20,ph20,vco2,pco2
DO 10 I=1,16
IF(TAV.LE.TT(I+1).AND.TAV.GE.TT(I))THEN
```

50

```
CPco2=Pco2(I)+(TAV-TT(I))*(Pco2(I+1)-Pco2(I))/(TT(I+1)-T
T(I))
GO TO 999
ENDIF
10          CONTINUE
999         S=CPco2
RETURN
END
FUNCTION CVco2(TAV,pco2,vco2,tt)
IMPLICIT REAL*8(A-H,O-Z)
DIMENSION Pco2(17),TT(17),Vco2(17)
c          COMMON PAIR,TT,VAIR,vn2,cn2,vh20,ph20,vco2,pco2
DO 10 I=1,16
IF(TAV.LE.TT(I+1).AND.TAV.GE.TT(I))THEN
CVco2=Vco2(I)+(TAV-TT(I))*(Vco2(I+1)-Vco2(I))/(TT(I+1)-T
T(I))
GO TO 999
ENDIF
10          CONTINUE
999         S=CVco2
RETURN
END
c            STEAM TABLES
 FUNCTION TSAT(PP)
 IMPLICIT REAL*8(A-H,O-Z)
 DIMENSION X(22),Y(22)
 DO 10 I=1,22
 X(I)=FLOAT(I)*I
10           CONTINUE
 Y (1) =101 . 64
 Y(2)=125.88
 Y(3)=141.32
 Y(4)=152.81
```

PCT/US 97/10200

```
Y(5)=162.09
Y(6)=170.02
Y(7)=176.8
Y(8)=182.77
Y(9)=188.2
Y(10)=193.17
Y(11)=197.73
Y(12)=201.92
Y(13)=205.74
Y(14)=209.46
Y(15)=212.94
Y(16)=216.09
Y(17)=219.23
Y(18)=222.37
Y(19)=225.11
Y(20)=227.78
Y(21)=230.45
Y(22)=233.05
DO 20 I=1,21
IF(PP.LE.x(I+1).AND.PP.GE.x(I))THEN
TSAT=y(I)+(PP-x(I))*(y(I+1)-y(I))/(x(I+1)-x(I))
GO TO 999
ENDIF
20          CONTINUE
999         S=TSAT
RETURN
END
```

E. Conclusion

While various embodiments of the present invention have been shown for illustrative purposes, the scope of protection of the present invention is limited only in accordance with the following claims and the spirit and scope of the appended claims should not be limited to the description of the preferred versions contained herein.

What is claimed is:

1. A method of operating an engine comprising the steps of:

compressing ambient air into compressed air having a pressure equal to or greater than six atmospheres, and having an elevated temperature;

ducting the flow of compressed air into a combustion chamber;

injecting controlled amounts of fuel into the combustion chamber the compressed air and fuel being mixed and ignited;

injecting controlled amounts of salt water into the combustion chamber down stream from a point of ignition;

independently controlling the amount of compressed air, the amount of fuel injected, and the amount of salt water injected so as to completely combust the injected fuel with the compressed air to create a hot combustion product, the injected liquid being transformed into a vapor, the vaporization of the salt water causing salt in the sea water to be deposited in the combustion chamber as molten salt and the transformation into a vapor providing substantially all of the cooling of the working fluid from downstream of the point of ignition; and removing the molten salt from the combustion chamber;

wherein a working fluid consisting of a mixture of any excess compressed air, fuel combustion products and vapor is generated in the combustion chamber during combustion at a predetermined combustion temperature.

2. The method of claim 1 where the mixture of air and fuel is ignited at startup using an ignition sparker.

3. The method of claim 1, wherein a desired portion of the vapor from the working fluid is condensed and the remaining portion of the working fluid is discarded.

4. The method of claim 1, wherein the vapor from the working fluid is condensed and the remainder of the working fluid is recycled for recompression.

5. The method of claim 1 further including the step of delivering the working fluid to at least one work engine.

6. The method of claim 1, wherein the temperature of the hot combustion product is controlled by using information obtained from temperature detectors and thermostats located in the combustion chamber to vary the volume of liquid infected and the location in the combustion chamber where the liquid is injected.

7. The method of claim 1, wherein the amount of liquid salt water and fuel injected is controlled during combustion such that the ratio of weight of injected liquid is at least two times the weight of injected fuel so that the mass of the working fluid is increased while reducing the temperature of the working fluid to a desired operating temperature for delivery to the work engine.

8. The method of claim 7, wherein the pressure of the compressed air is maintained at a pressure of 6 to 100 atmospheres, while entropy of the engine is held approximately constant.

9. The method of claim 7, wherein the air flow and fuel injection is controlled such that the ratio of weight of injected fuel to weight of injected air is from about 0.03 to 0.066 during combustion.

10. The method of claim 9, wherein the combustor temperature and the fuel to air ratio are independently controlled.

11. The method of claim 7, wherein at least about 40% of the compressed air is combusted in the combustion chamber.

12. The method of claim 1, wherein the pressure of the compressed air is maintained constant while the temperature of the combustion products and mass of working fluid mass is varied by the injection of the liquid.

13. The method of claim 1 wherein all chemical energy in the injected fuel is converted during combustion into thermal heat energy and the vaporization of liquid creates cyclonic turbulence that assists molecular mixing of the fuel and air such that stoichiometric combustion is effectuated.

14. The method of claim 1 wherein the liquid injected into the combustion chamber is water which is transformed into steam and the combustion products are cooled by way of the latent heat of vaporization of such water.

15. The method of claim 14 wherein the transformation into vapor of the injected water absorbs heat from the combustion products so as to reduce the temperature of the working fluid below that of a work engine maximum operating temperature.

16. The method of claim 14 wherein the injected water is transformed by way of a flash process into steam at a pressure of the combustion chamber without additional work for compression and without additional entropy or enthalpy.

17. The method of claim 14, wherein the working fluid is comprised of about 25% steam, 65% unoxidized nitrogen and 10% carbon dioxide.

18. The method of claim 14, wherein the salt water injected is used to control the combustion temperature and to prevent the formations of gases and compounds that cause or contribute to the formation of atmospheric smog.

19. The method of claim 1 further including the step of condensing potable water after the salt has been removed from the sea water which has been converted to a vapor.

20. The process of claim 1 wherein the inert liquid is sea water and the process further includes the collection of molten salt in the combustion chamber and the conversion of the molten salt to a solid form.

21. The method of claim 1 which further includes injecting liquid salt water into the air prior to mixing with the fuel.

22. The process of claim 1 further including directing the working fluid into a turbine power generator, wherein for every 1 pound per second of air feed the turbine power generator produces in excess of 750 horsepower at a fuel efficiency in excess of about 43 percent and an sfc of less than about 0.32.

23. The process of recovering salt and potable water from sea water, the salt being recovered in a preferred solid form comprising;

a) generating a flame in a combustion chamber by mixing and burning a carbon based fuel with a stoichiometric amount of air so that a hot gas stream of combustion products is created, b) reducing the temperature of the hot gas stream by injecting sea water into the hot gas stream, the reduced temperature of the hot gas stream being between the melting temperature and the boiling temperature of the salt in the sea water, the injection of the sea water causing the water to convert to steam upon entering the hot gas stream and the salt in the sea water to be deposited as a liquid in the combustion chamber, c) removing the liquid salt from the combustion chamber through means designed to convert the liquid salt into a solid of a preferred shape and size, and d) removing the steam and combustion products from the combustion chamber, passing the removed steam and combustion products through condensing means such that the steam is converted to water, separating the combustion products from the steam, and collecting the water so produced.

24. The process of claim 23 wherein the steam and combustion products are passed through a turbine power generator before being passed through the condensing means.

25. The process of claim 23 or 24 wherein substantially all of the carbon in the fuel is converted to carbon dioxide and substantially all of the nitrogen gas entering the combustion chamber in the air stream leaves the combustion chamber as nitrogen gas, the production of $NO_x$ from $N_2$ being substantially zero.

26. The process of claim 24 wherein the steam and combustion products passing through the turbine power generator causes the generation of power in the excess of 500 horsepower for each pound of air feed per second when the fuel to air ratio is in substantially stoichiometric amounts.

27. The process of claim 24 wherein the steam and combustion products passing through the turbine power generator causes the generation of power in excess of 650 horsepower for each pound of air feed per second when the fuel to air ratio is in substantially stoichiometric amounts.

28. The process of claim 24 wherein the steam and combustion products passing through the turbine power generator causes the generation of power in the excess of 800 horsepower for each pound of air feed per second when the fuel to air ratio is in substantially stoichiometric amounts.

* * * * *